US008244546B2

(12) United States Patent
Nakano et al.

(10) Patent No.: US 8,244,546 B2
(45) Date of Patent: Aug. 14, 2012

(54) SINGING SYNTHESIS PARAMETER DATA ESTIMATION SYSTEM

(75) Inventors: Tomoyasu Nakano, Ibaraki (JP); Masataka Goto, Ibaraki (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 684 days.

(21) Appl. No.: 12/470,086

(22) Filed: May 21, 2009

(65) Prior Publication Data

US 2009/0306987 A1 Dec. 10, 2009

(30) Foreign Application Priority Data

May 28, 2008 (JP) ..... 2008-139831

(51) Int. Cl.
*G10L 19/00* (2006.01)

(52) U.S. Cl. ..... 704/500; 434/318; 704/258; 704/268; 704/260; 704/265; 704/267; 84/604; 84/609; 84/645

(58) Field of Classification Search ..... 434/318; 704/258, 268, 260, 265, 267; 84/601, 609, 84/645

See application file for complete search history.

(56) References Cited

U.S. PATENT DOCUMENTS 5,518,408 A * 5/1996 Kawashima et al. ..... 434/307 A
5,654,516 A * 8/1997 Tashiro et al. ..... 84/601
5,857,171 A * 1/1999 Kageyama et al. ..... 704/268
6,836,761 B1 * 12/2004 Kawashima et al. ..... 704/258
7,065,489 B2 * 6/2006 Hisaminato et al. ..... 704/268
7,117,154 B2 * 10/2006 Yoshioka et al. ..... 704/258
7,183,482 B2 * 2/2007 Kobayashi ..... 84/645
7,271,329 B2 * 9/2007 Franzblau ..... 84/609
7,552,052 B2 * 6/2009 Kemmochi ..... 704/258
2009/0038468 A1 * 2/2009 Brennan ..... 84/609
2009/0076822 A1 * 3/2009 Sanjaume ..... 704/268

FOREIGN PATENT DOCUMENTS

JP 03-007994 1/1991

(Continued)

OTHER PUBLICATIONS

Orpheus; A Web-Based System for Automatic Song Composition Using the Lyric Prosody, Yuichiro Yonebayashi, et al., Interaction 2008, pp. 27-28, (English Translation Included).

(Continued)

*Primary Examiner* — Michael Colucci
(74) *Attorney, Agent, or Firm* — Rankin, Hill & Clark LLP

(57) ABSTRACT

There is provided a singing synthesis parameter data estimation system that automatically estimates singing synthesis parameter data for automatically synthesizing a human-like singing voice from an audio signal of input singing voice. A pitch parameter estimating section 9 estimates a pitch parameter, by which the pitch feature of an audio signal of synthesized singing voice is got closer to the pitch feature of the audio signal of input singing voice based on at least both of the pitch feature and lyric data with specified syllable boundaries of the audio signal of input singing voice. A dynamics parameter estimating section 11 converts the dynamics feature of the audio signal of input singing voice to a relative value with respect to the dynamics feature of the audio signal of synthesized singing voice, and estimates a dynamics parameter, by which the dynamics feature of the audio signal of synthesized singing voice is got close to the dynamics feature of the audio signal of input singing voice that has been converted to the relative value.

35 Claims, 16 Drawing Sheets

FOREIGN PATENT DOCUMENTS

JP 2009-217141 9/2009

OTHER PUBLICATIONS

NTT-AT Wonderhorn—http://www.ntt-at.co.jp/project/wonderhorn (English Translation Included) Jan. 20, 2010.
A. Camacho, "SWIPE: A Sawtooth Waveform Inspired Pitch Estimator for Speech and Music", Ph.D. Thesis, University of Florida, 116 pages, 2007.
Tetsuya, Kawahara, et al., "Product Software of Continuous Speech Recognition Consortium: 2002 Version", IPSJ SIG Technical Report 2003-SLP-48-1, pp. 1-6, 2003.15.
V.V. Digalakis, et al. "Speaker Adaptation Using Combined Transformation and Bayesian Methods", IEEE Transaction on Speech and Audio Processing, vol. 4, No. 4, pp. 294-300, 1996.16.
Tomoyasu Nakano, et al. "An Automatic Singing Skill Evaluation Method for Unknown Melodies", Transactions of Information Processing Society of Japan, vol. 48, No. 1, pp. 227-236, 2007.
Masataka Goto, et al. "RWC Music Database: Database of Copyright—cleared Music Pieces and Instrument Sounds for Research Purposes", Transactions of Information Processing Society of Japan, vol. 45, No. 3, pp. 728-738, 2004.
Transformation of Reading to Singing with Favorite Style, Tsuyoshi Moriyama, et al, Dept. of Media and Image Technology, Tokyo Polytechnic University, IPSJ SIG Technical Report 2008-MUS-74-6 pp. 33-38, English Abstract Included.
A Trainable Singing Voice Synthesis System Capable of Representing Personal Characteristics and Singing Styles, Shinji Sako, et al., IPSJ SIG Technical Report 2008, MUS-74-7, pp. 39-44, English Abstract Included.
Orpheus: A Web-Based System for Automatic Song Composition Using the Lyric Prosody, Yuichiro Yonebayashi, et al., Interaction 2008, pp. 27-28.
NTT-AT Wonderhorn—http://www.ntt-at.co.jp/project/wonderhorn, Jan. 20, 2010.
Performance-Driven Control for Sample-Based Singing Voice Synthesis, Jordi Janer, et al., Music Technology Group, Universitat Pompeu Fabra, Barcelona, Conference on Digital Audio Effects, pp. 41-44, English Abstract Included, 2006.
Scat Generation Research Program Based on Straight, a High-Quality Speech Analysis, Modification and Synthesis System, Hideki Kawahara, et al., Transactions of Information Processing Society of Japan, vol. 43, No. 2 pp. 208-218, English Abstract Included, 2002.
Singing Synthesis System "Vocaloid", Current Situation and Todo Lists, Hideki Kenmochi, et al., Center for Advanced Sound Technologies, Yamaha Corporation, IPSJ SIG Technical Report MUS-74-9, pp. 51-58, English Abstract Included, Feb. 8, 2008.
Sing by Speaking: Singing Voice Conversion System from Speaking Voice by Controlling Acoustic Features Affecting Singing Voice Perception, Takeshi Saitou, et al, National Institute of Advanced Industrial Science and Technology, IPSJ SIG Technical Report, MUS-74-5, pp. 25-32, English Abstract Included, 2008.
Singing Voice Synthesis System: CyberSingers, Yuki Yoshida, et al., NTT Intelligent Technology Co., Ltd., IPSJ SIG Technical Report 99-SLP-25-8, pp. 35-40, English Abstract Included, 1998.
Synthesis of the Singing Voice by Performance Sampling and Spectral Models, J. Bonada et al, IEEE Signal Processing Magazine, vol. 24, Iss.2, pp. 67-79, 2007.
Nakano, et al., "VocaListener: An Automatic Parameter Estimation System for Singing Synthesis by Mimicking User's Singing", IPSJ SIG Technical Report vol. 2008, No. 50, pp. 49-56 (Eight Pages).
Noike, K. "A Web Tool "VOCALOU" to make Singing Voice Materials for Contents Production", IPSJ SIG Technical Report vol. 2008 No. 26; pp. 97-102 (Six Pages).

* cited by examiner

SINGING SYNTHESIS PARAMETER DATA ESTIMATION SYSTEM

BACKGROUND OF THE INVENTION

The present invention relates to a singing synthesis parameter data estimation system, a singing synthesis parameter data estimation method, and a singing synthesis parameter data estimation program that automatically estimate singing synthesis parameter data from an audio signal of a user's input singing voice, for example, in order to support music production which uses singing synthesis.

Various researches have been so far made on generation of a human-like singing voice by a singing synthesis technology that uses a computer. Nonpatent Documents 1 through 3 listed below disclose methods of coupling elements (waveforms) of an audio signal of input singing voice that have been sampled. Nonpatent Document 4 listed below discloses a method of modeling an audio signal of singing voice to perform synthesis (HMM synthesis). Nonpatent documents 5 through 7 listed below disclose researches on analysis and synthesis of an audio signal of input singing voice from an audio signal of reading speech. In the researches described in Nonpatent Documents 5 through 7, high-quality singing synthesis with user's voice timbre preserved therein has been studied. By these researches, synthesis of the human-like singing voice is now getting possible, and some of the researches, which are a singing synthesis system "Vocaloid" (trademark) in Patent Document 3 and singing synthesis software in Patent Document 8 listed below, are commercialized.

When the user utilizes these related arts, there needs to be an interface that receives lyric data, musical score information that specifies a song, and a singing expression about "how the song is sung." In the arts of Nonpatent Documents 2 through 4, lyric data and musical score information (on a pitch, a pronunciation onset time, and a sound duration) are needed. In the art of Nonpatent Document 9 listed below, only lyric data is supplied to a singing synthesis system. In the arts of Patent Documents 5 through 7, an audio signal of read speech, lyric data, and musical score information are supplied to a singing synthesis system. In the art of Nonpatent Document 10 listed below, an audio signal of input singing voice and lyric data are supplied to a singing synthesis system. In contrast to these related arts, in the arts of Nonpatent Documents 2 and 3, the user adjusts a parameter on the singing expression among parameters supplied to a singing synthesis system. In the arts of Nonpatent Documents 4 and 6, the way of singing or singing style is modeled in advance. In the method described in Nonpatent Document 7, a musical symbol (for crescendo or the like) is supplied to the singing synthesis system. In the method of Nonpatent Document 10, a parameter on the singing expression is extracted from an audio signal of input singing voice.

However, none of the related arts can iteratively estimate the parameters or can modify the pitch or the dynamics of an audio signal of input singing voice, even if the audio signal of input singing voice can be supplied as an input. In the singing synthesis system "Vocaloid" (trademark) manufactured and sold by Yamaha Corporation, the user supplies lyric information and musical score information to the "Vocaloid", using a piano roll score editor, and manipulates parameters for adding expressive effects, thereby synthesizing a singing voice.

Fine adjustment of the parameters for adding expressive effects is needed in order to obtain a more natural or a more individualistic singing voice. However, depending on capability of the user, it is difficult to create a singing voice desired by the user. Further, when a condition for singing synthesis (such as a singing synthesis system or sound source data of the singing synthesis system) differs, parameter data for constituting the singing voice needs to be adjusted again.

Nonpatent Document 10 proposes the method of extracting features such as a pitch, dynamics, and vibrato information (on a vibrato extent and a vibrato frequency) upon reception of the audio signal of input singing voice and the lyric data, and supplying the extracted features as a singing synthesis parameter. In the art described in Nonpatent Document 10, it is assumed that the singing synthesis parameter data thus obtained is edited by the user on the score editor of the singing synthesis system. However, even if the features of the pitch and the like extracted from the audio signal of input singing voice are used as the singing synthesis parameter without alteration or even if an editing operation that uses the existing editor of the singing synthesis system is performed, a change in singing synthesis conditions cannot be accommodated.

In the art described in Nonpatent Document 10, determination of a pronunciation onset time and a sound duration for each syllable of lyrics (hereinafter referred to as lyric alignment) is automatically made by Viterbi alignment used in speech recognition technology. Then, in order to obtain high-quality synthesized sounds, it is necessary to obtain the lyric alignment having almost 100 percent accuracy. However, only with the Viterbi alignment, it is difficult to obtain such a high accuracy. Further, results of the lyric alignment do not completely match synthesized sounds that have been output. However, any conventional arts have not improved this mismatch.

Incidentally, the documents of the related arts are as follows:

[Nonpatent Document 1]
J. Bonada et al.: "Synthesis of the Singing Voice by Performance Sampling and Spectral Models," In IEEE Signal Processing Magazine, Vol. 24, Iss. 2, pp. 67-79, 2007.
[Nonpatent Document 2]
Yuki Yoshida et al.: "Singing Synthesis System: CyberSingers," IPSJ SIG Technical Report 99-SLP-25-8, pp. 35-40, 1998.
[Nonpatent Document 3]
Hideki Kenmochi et al.: "Singing Synthesis System "VOCALOID" Current Situation and Todo lists," IPSJ SIG Technical Report 2008-MUS-74-9, pp. 51-58, 2008.
[Nonpatent Document 4]
Shinji Sako et al.: "A Trainable Singing Voice Synthesis System Capable of Representing Personal Characteristics and Singing Styles," IPSJ SIG Technical Report 2008-MUS-74-7, pp. 39-44, 2008.
[Nonpatent Document 5]
Hideki Kawahara et al.: "Scat Generation Research Program Based on STRAIGHT, a High-quality Speech Analysis, Modification and Synthesis System," Transactions of Information Processing Society of Japan, Vol. 43, No. 2, pp. 208-218, 2002.
[Nonpatent Document 6]
Takeshi Saitou et al.: "SingBySpeaking: Singing Voice Conversion System from Speaking Voice By Controlling Acoustic Features Affecting Singing Voice Perception," IPSJ SIG Technical Report 2008-MUS-74-5, pp. 25-32, 2008.
[Nonpatent Document 7]
Tsuyoshi Moriyama et al.: "Transformation of Reading to Singing with Favorite Style," IPSJ SIG Technical Report 2008-MUS-74-6, pp. 33-38, 2008.
[Nonpatent Document 8]
NTT-AT Wonderhorn (http://www.ntt-at.co.jp/product/wonderhorn/)

[Nonpatent Document 9]

Yuichiro Yonebayashi et al: "A Web-based System for Automatic Song Composition Using the Lyric Prosody," Interaction 2008, pp. 27-28, 2008.

[Nonpatent Document 10]

J. Janer et al.: "Performance-Driven Control for Sample-Based Singing Voice Synthesis," In DAFx-06, pp. 42-44, 2006.

SUMMARY OF THE INVENTION

An object of the present invention is to provide a singing synthesis parameter data estimation system, a singing synthesis parameter estimation method, and a singing synthesis parameter data estimation program that automatically estimate singing synthesis parameter data for synthesizing a high-quality human-like singing voice from an audio signal of input singing voice.

A more specific object of the present invention is to provide a singing synthesis parameter data estimation system, a singing synthesis parameter estimation method, and a singing synthesis parameter data estimation program that may accommodate a change in singing synthesis conditions by iteratively updating a pitch parameter and a dynamics parameter which constitute singing synthesis parameter data so that synthesized singing voice gets close to input singing voice.

In addition to the above-mentioned objects, another object of the present invention is to provide a singing synthesis parameter data estimation system that may modify a singing voice element such as pitch deviation or a vibrato for an audio signal of input singing voice.

A singing synthesis parameter data estimation system according to the present invention estimates singing synthesis parameter data used in a singing synthesis system and suited to selected singing sound source data. The singing synthesis system that may use the singing synthesis parameter data estimated by the system of the present invention comprises: a singing sound source database storing one or more singing sound source data; a singing synthesis parameter data storing section that stores singing synthesis parameter data which represents an audio signal of singing voice by a plurality of parameters including at least both of a pitch parameter and a dynamics parameter; a lyric data storing section that stores lyric data having specified syllable boundaries corresponding to an audio signal of input singing voice; and a singing synthesis section that synthesizes and outputs an audio signal of synthesized singing voice suited to the singing sound source data selected from the singing sound source database, based on the singing sound source data, the singing synthesis parameter data, and the lyric data.

The singing synthesis parameter data estimation system of the present invention comprises: an input singing voice audio signal analysis section; a pitch parameter estimating section; a dynamics parameter estimating section; and a singing synthesis parameter data estimating section.

The input singing voice audio signal analysis section analyzes a plurality of features of the audio signal of input singing voice. The features include at least both of a pitch feature and a dynamics feature. The pitch parameter estimating section estimates the pitch parameter, by which a pitch feature of the audio signal of synthesized singing voice is get close to the pitch feature of the audio signal of input singing voice, based on at least both of the pitch feature and the lyric data of the audio signal of input singing voice, with the dynamics parameter kept constant. Then, the pitch parameter estimating section obtains a temporary audio signal of synthesized singing voice by synthesis of temporary singing synthesis parameter data estimated based on the estimated pitch parameter. Then, the pitch parameter estimating section repeats estimation of the pitch parameter predetermined times until the pitch feature of the temporary audio signal of synthesized singing voice reaches a pitch feature close to the pitch feature of the audio signal of input singing voice, or repeats estimation of the pitch parameter until the pitch feature of the temporary audio signal of synthesized singing voice converges to the pitch feature of the audio signal of input singing voice. With this arrangement, even if the sound source data differs and even if the singing synthesis system differs, the pitch feature of the temporary audio signal of synthesized singing voice automatically reaches the pitch feature close to the pitch feature of the audio signal of input singing voice.

In the present invention, after the pitch parameter has been estimated, the dynamics parameter estimating section converts the dynamics feature of the audio signal of input singing voice to a relative value with respect to the dynamics feature of the audio signal of synthesized singing voice and estimates the dynamics parameter, by which the dynamics feature of the audio signal of synthesized singing voice is got close to the dynamics feature of the audio signal of input singing voice that has been converted to the relative value. The dynamics parameter estimating section obtains a temporary audio signal of synthesized singing voice by synthesis of temporary singing synthesis parameter data generated based on the pitch parameter completely estimated by the pitch parameter estimating section and the estimated dynamics parameter. Then, the dynamics parameter estimating section repeats estimation of the dynamics parameter predetermined times until the dynamics feature of the temporary audio signal of synthesized singing voice reaches a dynamics feature close to the dynamics feature of the audio signal of input singing voice that has been converted to the relative value, or repeats estimation of the dynamics parameter until the dynamics feature of the temporary audio signal of synthesized singing voice converges to the dynamics feature of the audio signal representing the input singing voice that has been converted to the relative value. When the estimation of the dynamics parameter is repeated as in the estimation of the pitch parameter, the accuracy of the estimation of the dynamics parameter may be more increased.

The singing synthesis parameter data estimating section estimates the singing synthesis parameter data, based on the pitch parameter estimated by the pitch parameter estimating section and the dynamics parameter estimated by the dynamics parameter estimating section to store the singing synthesis parameter data in the singing synthesis parameter data storing section.

After the pitch parameter is changed, the dynamics parameter is also changed. However, there is scarcely a singing synthesis system where the pitch parameter is also changed after the dynamics parameter is changed. For this reason, if the dynamics parameter is estimated after the pitch parameter has been completely estimated as in the present invention, there may be no need to estimate the pitch parameter again. Consequently, according to the present invention, the singing voice synthesis parameter data may be easily generated in a short time. However, in the case of an exceptional singing synthesis system where the pitch parameter is also changed after the dynamics parameter is changed, it is necessary to estimate the dynamics parameter after the pitch parameter has been estimated and then estimate the pitch parameter again. Further, according to the present invention, the pitch parameter and the dynamics parameter are estimated a plurality of times. Thus, a change in singing synthesis conditions may be accommodated, and the singing synthesis parameter data for synthesizing a high-quality human-like singing voice may be automatically estimated from the audio signal of input singing voice with high accuracy.

Any parameter that can represent a variation in pitch may be used as the pitch parameter. The pitch parameter may comprise a parameter element representing a reference pitch level for each of signals in a plurality of partial segments of the audio signal of input singing voice; a parameter element indicating the temporal relative pitch variation of each of the signals in the partial segments with respect to the reference pitch level; and a parameter element indicating the variation width of each of the signals in the partial segments in a pitch direction, for example. The partial segments respectively correspond to a plurality of syllables of the lyric data. Specifically, the parameter element indicating the reference pitch level is a note number compliant with the MIDI standard or the note number of a commercially available singing synthesis system, for example. The parameter element indicating the temporal relative pitch variation with respect to the reference pitch level is a pitch bend (PIT) in compliant with the MIDI standard or the pitch bend (PIT) of the commercially available singing synthesis system. The parameter element indicating the variation width in the pitch direction is a pitch bend sensitivity (PBS) compliant with the MIDI standard or the pitch bend sensitivity (PBS) of the commercially available singing synthesis system.

If the pitch parameter is constituted from the three parameter elements in this manner, the pitch parameter estimating section may be configured as follows to allow estimation of these parameter elements. First, the pitch parameter estimating section sets the predetermined initial value of the parameter element indicating the temporal relative pitch variation and the predetermined initial value of the parameter element indicating the variation width in the pitch direction after determining the parameter element indicating the reference pitch level. Next, the pitch parameter estimating section generates the temporary singing synthesis parameter data based on the initial values, and obtains the temporary audio signal of synthesized singing voice by synthesis of the temporary singing synthesis parameter data by the singing synthesis section. Then, the pitch parameter estimating section estimates the parameter element indicating the temporal relative pitch variation and the parameter element indicating the variation width in the pitch direction so that the pitch feature of the temporary audio signal of synthesized singing voice reaches a pitch feature close to the pitch feature of the audio signal of input singing voice. Then, the pitch parameter estimating section generates next temporary singing synthesis parameter data based on the estimated parameter elements, and repeats estimation of the parameter elements indicating the temporal relative pitch variation and the variation width in the pitch direction so that the pitch feature of a temporary audio signal of synthesized singing voice obtained by synthesis of the next temporary singing synthesis parameter data by the singing synthesis section reaches a pitch feature close to the pitch feature of the audio signal of input singing voice. With this arrangement, after the reference pitch level has been first determined, the remaining two parameter elements should be iteratively estimated. Thus, estimation of the parameter elements is facilitated, and the pitch parameter may be constituted from the three parameter elements.

Preferably, the dynamics parameter estimating section includes the following two functions, in order to estimate the dynamics parameter. One is the function of determining a normalization factor $\alpha$ so that a distance between the dynamics feature of a temporary audio signal of synthesized singing voice and the dynamics feature of the audio signal of input singing voice is the smallest. The temporary audio signal of synthesized singing voice is obtained by synthesis of temporary singing synthesis parameter data by the singing synthesis section. The temporary singing synthesis parameter data is generated based on the completely estimated pitch parameter and the dynamics parameter set to the central value of a settable dynamics parameter range. The other is the function of multiplying the dynamics feature of the audio signal of input singing voice by the normalization factor $\alpha$, thereby estimating the dynamics feature converted to the relative value. If these two functions are included, even if the dynamics feature of the audio signal of input singing voice is significantly larger or smaller than the dynamics feature of the temporary signal of synthesized voice obtained by synthesis by the singing synthesis section, the dynamics parameter may be appropriately estimated by conversion to the relative value.

Any parameter that can represent a variation in dynamics may be used as the dynamics parameter. The dynamics parameter, for example, is an expression compliant with the MIDI standard or "dynamics (DYN)" of the commercially available singing synthesis system. If "the dynamics" are used as the dynamics parameter, the dynamics feature of the audio signal of input singing voice as a whole is converted to the relative value in terms of "the dynamics". It is so arranged that most of the dynamics features of the respective syllables of the audio signal of input singing voice fall within "a dynamics settable range" in which the dynamics feature of the temporary audio signal of synthesized singing voice for each value of the range is present. Then, estimation of the dynamics parameter ("dynamics") for each syllable should be repeated so that the dynamics feature of the temporary audio signal of synthesized singing voice obtained by the current parameter reaches a dynamics feature close to the dynamics feature of the audio signal of input singing voice that has been converted to the relative value.

If lyric data without specified syllable boundaries is supplied to the singing synthesis parameter data estimation system, a lyric alignment section should be further provided. The lyric alignment section generates the lyric data having the specified syllable boundaries, based on the lyric data without the specified syllable boundaries and the audio signal of the input singing voice. If the lyric alignment section is provided, the lyric data with the specified syllable boundaries may be readily provided by the singing synthesis parameter data estimation system even if the lyric data without the specified syllable boundaries has been supplied to the system. The lyric alignment section may be arbitrarily configured. For example, the lyric alignment section may comprise: a phoneme sequence converting section; a phoneme manual modifying section; an alignment estimating section; an alignment and manual modifying section; a phoneme-to-syllable sequence converting section; a voiced segment amending section; a syllable boundary correcting section; and a lyric data storing section. The phoneme sequence converting section converts lyrics included in the lyric data into a phoneme sequence composed of a plurality of phonemes. The phoneme manual modifying section allows manual modification of a result of the conversion by the phoneme sequence converting section. The alignment estimating section estimates a start time and a finish time of each of the phonemes included in the phoneme sequence in the audio signal of input singing voice after estimating an alignment grammar. The alignment and manual modifying section allows manual modification of the start time and the finish time of each of the phonemes included in the phoneme sequence estimated by the alignment estimating section. The phoneme-to-syllable sequence converting section converts the phoneme sequence into a sequence of syllables. The voiced segment amending section amends a deviation of the voiced segment in the syllable sequence output from the phoneme-to-syllable sequence converting section. When a user manually points out an error in a syllable boundary, the syllable boundary correcting section allows correction of the syllable boundary error in the syllable sequence where the deviation of the voiced segment has been amended. The lyric data storing section stores the syllable sequence as the lyric data having the specified syllable boundaries. When the lyric alignment section of such a configuration is used, the user is involved in the alignment of a lyric portion of which automatic modification or automatic determination is difficult. Accordingly, lyric alignment may be achieved with higher accuracy. As a result, lyric data with specified syllable boundaries may be readily provided by the singing synthesis parameter data estimation system even if lyric data without specified syllable boundaries is supplied to the system.

Preferably, the voiced segment amending section comprises: a partial syllable sequence generating section that connects a plurality of the syllables included in one of the voiced segments resulting from analysis by the input singing voice audio signal analysis section, thereby generating a partially connected syllable sequence; and an expansion and contraction modifying section that extends or contracts the syllable by changing the start time and the finish time of each of the syllables included in the partially connected syllable sequence so that a voiced segment resulting from analysis of the temporary audio signal of synthesized singing voice obtained by synthesis by the singing synthesis section coincides with the voiced segment resulting from the analysis by the input singing voice audio signal analysis section. If the partial syllable sequence generating section and the expansion and contraction modifying section like these are provided, a voiced segment deviation may be automatically amended.

The syllable boundary correcting section may comprise: a calculating section that calculates a temporal variation in a spectrum of the audio signal of input singing voice; and a correction executing section. The correction executing section executes correction through the user. The correction executing section executes the correction as follows. First, the correction executing section sets a segment comprising N1(N1 being a positive integer of one or more) syllables before a point of the syllable boundary error and N1 syllables after the point of the syllable boundary error to a candidate calculation target segment. The correction executing section sets a segment comprising N2 (N2 being a positive integer of one or more) syllables before the point of the syllable boundary error and N2 syllables after the point of the syllable boundary error to a distance calculation segment. Then, the correction executing section determines N3 (N3 being a positive integer of one or more) points with large temporal variations in the spectrum as boundary candidate points based on a temporal variation in the spectrum in the candidate calculation target segment. Next, the correction executing section obtains distances of hypotheses where the syllable boundary is shifted to the respective boundary candidate points, presents one of the hypotheses having the minimum distance to the user. The correction executing section moves down the boundary candidate point to present another hypothesis until the user determines the presented another hypothesis to be correct. Then, if the user determines the presented another hypothesis to be correct, the correction executing section executes the correction by shifting the syllable boundary to the boundary candidate point for the presented another hypothesis. When the hypothesis of a portion for which automation of error correction is difficult is presented to call for judgment by the user as in this manner, the accuracy of correcting a syllable boundary error may be considerably increased.

In this case, in order to obtain the distance of the hypothesis where the syllable boundary is shifted to each boundary candidate point, the correction executing section estimates the pitch parameter for the distance calculation segment, obtains an audio signal of synthesized singing voice by synthesis of the singing synthesis parameter data based on the estimated pitch parameter, and calculates a spectral distance between the audio signal of input singing voice and the temporary audio signal of synthesized singing voice for the overall distance calculation segment as the distance of hypothesis. If the distance of the hypothesis is calculated in this manner, distance calculation which focuses attention on a spectral shape difference or a syllable difference may be performed. As the temporal variation in spectrum, a delta Mel-Frequency Cepstrum Coefficient (ΔMFCC), for example, should be calculated.

Any section that can analyze (extract) the features of the audio signal of input singing voice may be used as the input singing voice audio signal analysis section. Preferably, the input singing voice audio signal analysis section has the following three functions. A first function is the function of estimating a fundamental frequency Fo from the audio signal of input singing voice in a predetermined cycle, monitoring the pitch of the audio signal of input singing voice based on the fundamental frequency, and then storing the monitored pitch in an analyzed data storing section as pitch feature data. The fundamental frequency Fo may be estimated by an arbitrary method. A second function is the function of estimating a voiced sound property (periodicity) from the audio signal of input singing voice, monitoring a segment in which the voiced sound property (periodicity) is higher than a predetermined threshold value as a voiced segment of the audio signal of input singing voice, and storing the voiced segment in the analyzed data storing section. Then, a third function is the function of monitoring the dynamics feature of the audio signal of input singing voice and then storing the monitored dynamics feature in the analyzed data storing section as dynamics feature data.

Music quality of the audio signal of input singing voice is not constantly guaranteed. There are some singing voices that are off-pitch or have strange vibrato. Further, in many cases, there is a difference in key between male and female singing voices. Then, in order to cope with such situations, it is preferable that the audio signal of input singing voice may be modified or altered. For doing so, an off-pitch amount estimating section and a pitch compensating section are further provided. The off-pitch amount estimating section estimates an off-pitch amount from the pitch feature data in voiced segments of the audio signal of the input singing voice, stored in the analyzed data storing section. The pitch compensating section compensates for the pitch feature data so that the off-pitch amount estimated by the off-pitch estimating section is removed from the pitch feature data. If the off-pitch amount is estimated and removed, an audio signal of input singing voice with a low off-pitch level may be obtained.

Further, a pitch transposing section may be provided. The pitch transposing section adds an arbitrary value to the pitch feature data, thereby performing pitch transposition. If the pitch transposing section is provided, the voice region of the audio signal of input singing voice may be readily altered or transposition of the audio signal may be readily performed.

The input singing voice audio signal analysis section may further comprise a function of monitoring a segment where a vibrato is present from the pitch feature data and then storing the segment with the vibrato in the analyzed data storing section as a vibrato segment. If the input singing voice audio signal analysis section includes such a function, and if a vibrato adjusting section that arbitrarily adjusts a vibrato extent in the vibrato section is further provided, the vibrato may be arbitrarily adjusted. If the smoothing section that arbitrarily smoothes the pitch feature data and the dynamics feature data in segments other than the vibrato segment is further provided, the vibrato segment may be accurately removed, and smoothing may be performed. The smoothing processing herein refers to processing equivalent to "arbitrary vibrato extent adjustment". The smoothing processing has an effect of increasing or reducing a variation in pitch or dynamics.

Currently, the singing synthesis parameter estimation system including all of the characteristics described above is practically the most preferable. However, even if the singing synthesis parameter data estimation system includes at least one of the characteristics, individual problems of conventional systems may be solved.

The present invention may be carried out as a singing synthesis parameter data estimation method of estimating singing synthesis parameter data used in a singing synthesis system by a computer. The singing synthesis system comprises: a singing sound source database; a singing synthesis parameter data storing section; a lyric data storing section; and a singing synthesis section. The singing sound source database stores one or more singing sound source data. The singing synthesis parameter data storing section stores singing synthesis parameter data which represents an audio signal of singing voice by a plurality of parameters including at least both of a pitch parameter and a dynamics parameter. The lyric data storing section stores lyric data having specified syllable boundaries corresponding to an audio signal of input singing voice. The singing synthesis section synthesizes and outputs an audio signal of synthesized singing voice suited to the singing sound source data selected from the singing sound source database, based on the singing sound source data, the singing synthesis parameter data, and the lyric data. The singing synthesis parameter data estimation method implemented by the computer comprise: analyzing a plurality of features of the audio signal of input singing voice, the features including at least both of a pitch feature and a dynamics feature; estimating the pitch parameter, by which the pitch feature of the audio signal of synthesized singing voice is got close to the pitch feature of the audio signal of input singing voice, based on at least both the pitch feature and the lyric data of the audio signal of input singing voice, with the dynamics parameter kept constant; converting the dynamics feature of the audio signal of input singing voice to a relative value with respect to the dynamics feature of the audio signal of synthesized singing voice after the pitch parameter has been completely estimated; estimating the dynamics parameter by which the dynamics feature of the audio signal of synthesized singing voice is get close to the dynamics feature of the audio signal of input singing voice that has been converted to the relative value; and estimating the singing synthesis parameter data, based on the estimated pitch parameter and the estimated dynamics parameter to store the singing synthesis parameter data in the singing synthesis parameter data storing section. The method further comprises: repeating estimation of the pitch parameter predetermined times until the pitch feature of a temporary audio signal of synthesized singing voice reaches a pitch feature close to the pitch feature of the audio signal of input singing voice, or repeating estimation of the pitch parameter until the pitch feature of the temporary audio signal of synthesized singing voice converges to the pitch feature of the audio signal of input singing voice, the temporary audio signal of synthesized singing voice being obtained by synthesis of temporary singing synthesis parameter data estimated based on the estimated pitch parameter, by the singing synthesis section; and repeating estimation of the dynamics parameter predetermined times until the dynamics feature of a temporary audio signal of synthesized singing voice reaches a dynamics feature close to the dynamics feature of the audio signal of input singing voice that has been converted to the relative value, or repeating estimation of the dynamics parameter until the dynamics feature of the temporary audio signal of synthesized singing voice converges to the dynamics feature of the audio signal of input singing voice that has been converted to the relative value, the temporary audio signal of synthesized singing voice being obtained by synthesis of temporary singing synthesis parameter data by the singing synthesis section, the temporary singing synthesis parameter data being generated based on the completely estimated pitch parameter and the estimated dynamics parameter.

The present invention may also be carried out as a singing synthesis parameter data estimation program implemented by a computer when the computer estimates singing synthesis parameter data used in a singing synthesis system. The singing synthesis system comprises: a singing sound source database; a singing synthesis parameter data storing section; a lyric data storing section; and a singing synthesis section. The singing sound source database stores one or more singing sound source data. The singing synthesis parameter data storing section stores singing synthesis parameter data which represents an audio signal of singing voice by a plurality of parameters including at least both of a pitch parameter and a dynamics parameter. The lyric data storing section stores lyric data having specified syllable boundaries corresponding to an audio signal of input singing voice. The singing synthesis section synthesizes and outputs an audio signal of synthesized singing voice suited to the singing sound source data selected from the singing sound source database, based on the singing sound source data, the singing synthesis parameter data, and the lyric data. The singing synthesis parameter data estimation program configures in the computer: an input singing voice audio signal analysis section; a pitch parameter estimating section; a dynamics parameter estimating section; and a singing synthesis parameter data estimating section. The input singing voice audio signal analysis section analyzes a plurality of features of the audio signal of input singing voice. The features include at least a pitch feature and a dynamics feature. The pitch parameter estimating section estimates the pitch parameter, by which the pitch feature of the audio signal of synthesized singing voice is get close to the pitch feature of the audio signal of input singing voice, based on at least both of the pitch feature and the lyric data of the audio signal of input singing voice, with the dynamics parameter kept constant. After the pitch parameter estimating section has completed estimation of the pitch parameter, the dynamics parameter estimating section converts the dynamics feature of the audio signal of input singing voice to a relative value with respect to the dynamics feature of the audio signal of synthesized singing voice and estimates the dynamics parameter, by which the dynamics feature of the audio signal of synthesized singing voice is get close to the dynamics feature of the audio signal of input singing voice that has been converted to the relative value. The singing synthesis parameter data estimating section estimates the singing synthesis parameter data, based on the pitch parameter estimated by the pitch parameter estimating section and the dynamics parameter estimated by the dynamics parameter estimating section to store the singing synthesis parameter data in the singing synthesis parameter data storing section. The pitch parameter estimating section repeats estimation of the pitch parameter predetermined times until the pitch feature of a temporary audio signal of synthesized singing voice reaches a pitch feature close to the pitch feature of the audio signal of input singing voice, or repeats estimation of the pitch parameter until the pitch feature of the temporary audio signal of synthesized singing voice converges to the pitch feature of the audio signal of input singing voice, the temporary audio signal of synthesized singing voice being obtained by synthesis of temporary singing synthesis parameter data estimated based on the estimated pitch parameter, by the singing synthesis section. The dynamics parameter estimating section repeats estimation of the dynamics parameter predetermined times until the dynamics feature of a temporary audio signal of synthesized singing voice reaches a dynamics feature close to the dynamics feature of the audio signal of input singing voice that has been converted to the relative value, or repeats estimation of the pitch parameter until the dynamics feature of the temporary audio signal of synthesized singing voice converges to the dynamics feature of the audio signal of input singing voice that has been converted to the relative value, the temporary audio signal of synthesized singing voice being obtained by synthesis of temporary singing synthesis parameter data by the singing synthesis section, the temporary singing synthesis parameter data being generated based on the pitch parameter estimated by the pitch parameter estimating section and the estimated dynamics parameter. The singing synthesis parameter data estimation program may be of course stored in a storage medium readable by the computer.

According to the present invention, the singing synthesis parameter data estimation system, singing synthesis parameter data estimation method, and singing synthesis parameter data estimating program capable of automatically estimating singing synthesis parameter data for synthesizing a high-quality human-like singing voice from the audio signal of input singing voice may be provided. The synthesis is performed so that synthesized singing voice gets close to input singing voice. Accordingly, the present invention may help various users who utilize an existing singing synthesis system to freely produce an attractive singing voice. Possibility of music expression through singing may be thereby expanded.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF PREFERRED EMBODIMENT

Figure 1:
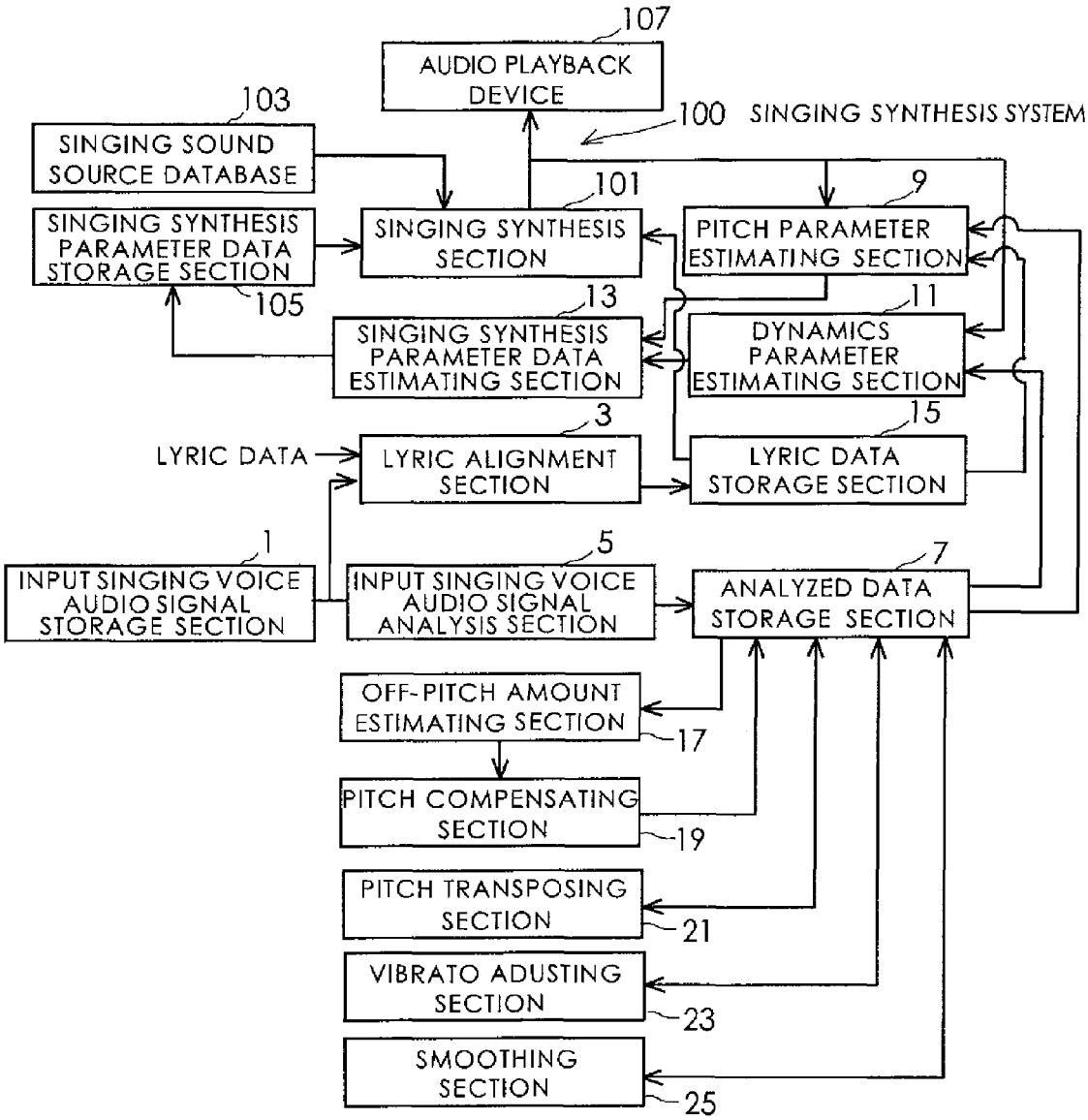
FIG. 1 is a block diagram showing an example of a configuration of a singing synthesis parameter data estimation system in an embodiment of the present invention.

An embodiment of a singing synthesis parameter data estimation system of the present invention will be described below with reference to drawings. FIG. 1 is a block diagram showing a configuration of the singing synthesis parameter data estimation system in the embodiment of the present invention. In the singing synthesis parameter data estimation system in this embodiment, singing synthesis parameter data is iteratively updated while comparing synthesized singing (audio signal of synthesized singing voice) with input singing (audio signal of input singing voice). An audio signal of singing given by a user is referred to as the audio signal of input singing voice, and an audio signal of synthesized singing synthesized by a singing synthesis system is referred to as the audio signal of synthesized singing voice.

In this embodiment, it is assumed that the user supplies the audio signal of input singing voice and lyric data on the input singing voice to the system as inputs. The audio signal of input singing voice is stored in an input singing voice audio signal storage section 1. The audio signal of input singing voice may be an audio signal of the singing voice of the user input through a microphone or the like, an audio signal of singing voice provided in advance, or an audio signal output by another arbitrary singing synthesis system. The lyric data is usually data on character strings of sentences including Japanese characters "kanji" and "kana". The lyric data is supplied to a lyric alignment section 3, which will be described later. An input singing voice audio signal analysis section 5 analyzes the audio signal of input singing voice. The lyric alignment section 3 converts the input lyric data into lyric data having specified syllable boundaries so that the lyric data is synchronized with the audio signal of the input singing voice, and stores a result of conversion in a lyric data storage section 15. The lyric alignment section 3 allows manual correction by the user when an error has occurred at a time of conversion of a sentence including Japanese characters "kanji" and "kana" into a character string composed of Japanese characters "kana" alone, or a great error that extends over phrases has occurred at a time of lyric allocation. When the lyric data having the specified syllable boundaries is supplied, the lyric data is directly supplied to the lyric data storage section 15.

The singing synthesis parameter data estimation system shown in FIG. 1 estimates singing synthesis parameter data suited to singing sound source data selected from a singing sound source database 103 and used in an existing singing synthesis section 101 and stores the estimated singing synthesis parameter data in a singing synthesis parameter data storage section 105. The singing synthesis system capable of using the singing synthesis parameter data comprises: the singing sound source database 103 that stores one or more singing sound source data; and the singing synthesis parameter data storage section 105 that stores the singing synthesis parameter data which represents the audio signal of input singing voice by a plurality of parameters including at least both of a pitch parameter and a dynamics parameter; and the singing synthesis section 101. The singing synthesis section 101 synthesizes the audio signal of synthesized singing voice, based on the singing sound source data selected from the singing sound source database, the singing synthesis parameter data, and the lyric data, and outputs the synthesized audio signal to a audio playback device 107. The audio playback device 107 reproduces the audio signal of synthesized singing voice. Needless to say, the audio signal may be stored in a hard disk or the like as a speech file, without being directly reproduced.

Figure 2:
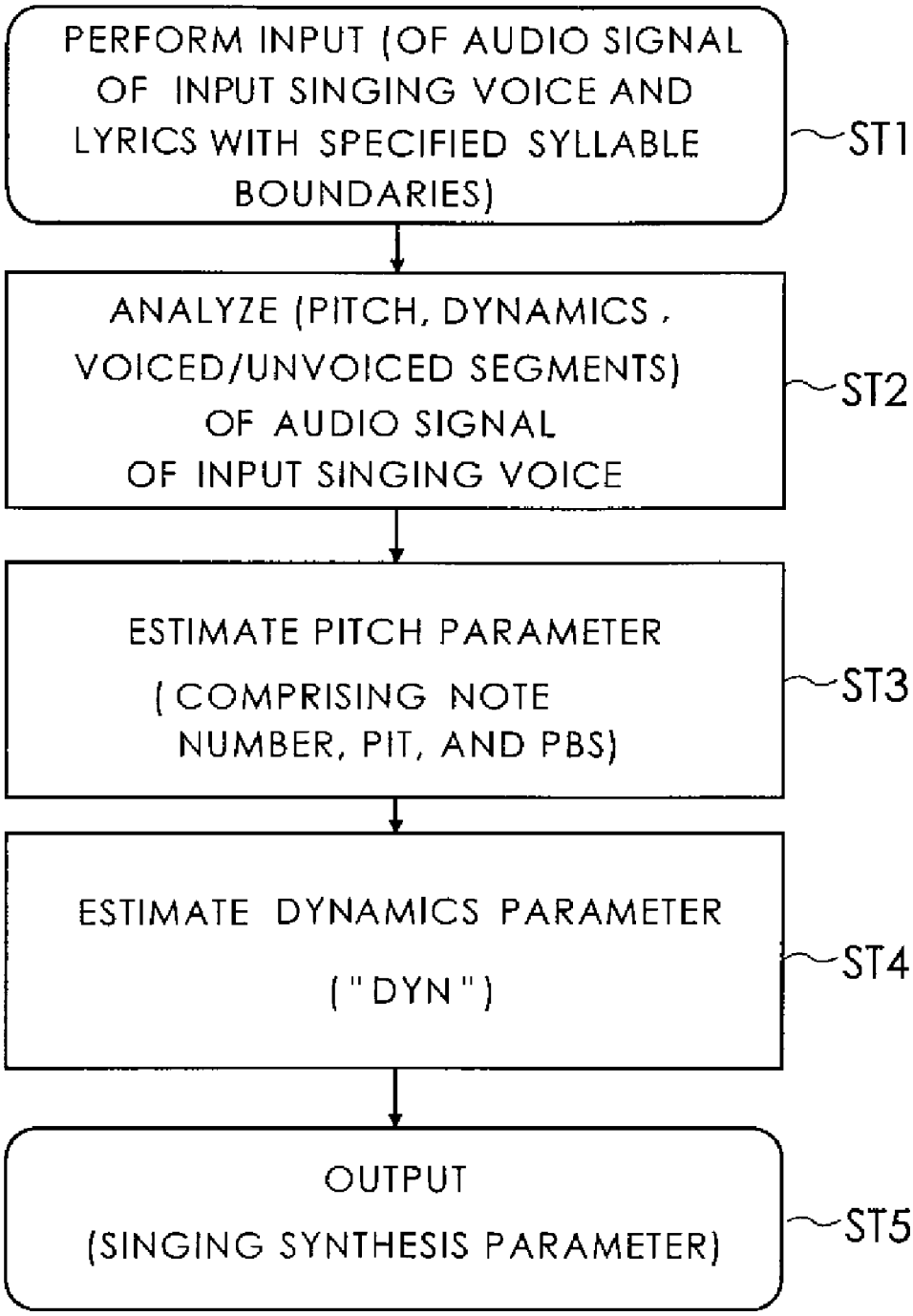
FIG. 2 is a flowchart showing a highest-order algorithm of a program used when the singing synthesis parameter data estimation system is implemented by a computer.

The singing synthesis parameter data estimation system in this embodiment mainly comprise: the input singing voice audio signal analysis section 5, an analyzed data storage section 7, a pitch parameter estimating section 9, a dynamics parameter estimating section 11, and a singing synthesis parameter data estimating section 13. FIG. 2 shows a highest-order algorithm of a program used when the singing synthesis parameter data estimation system is implemented by a computer. In step ST1, input is performed. In step ST2, the audio signal of input singing voice is analyzed. In step ST3, the pitch parameter is estimated. In step ST4, the dynamics parameter is estimated. Then, in step ST5, the singing synthesis parameter is estimated.

Figure 3:
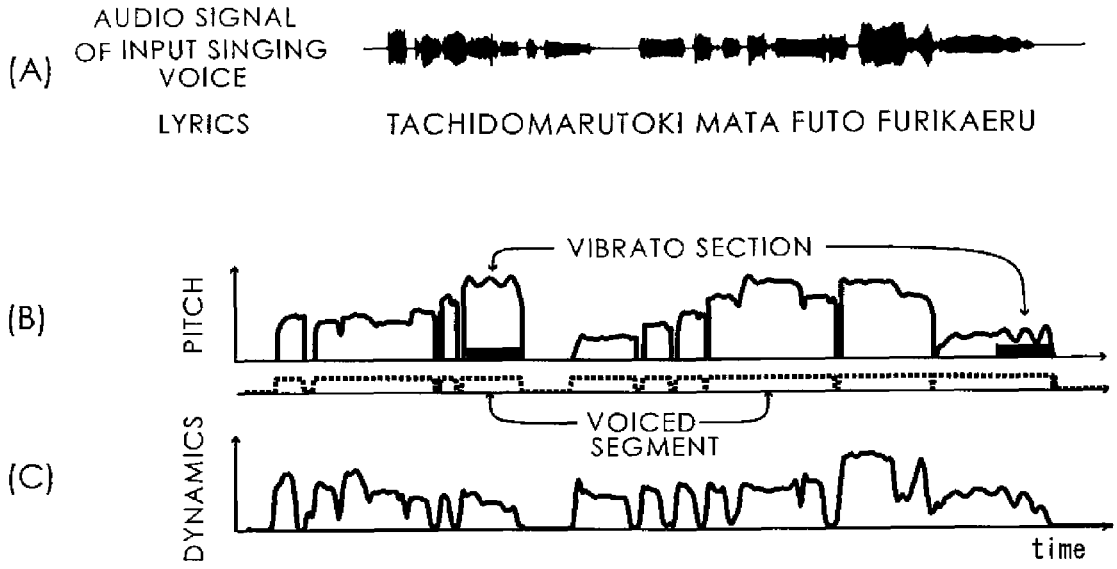
FIG. 3A is a graph showing an example of an audio signal of input singing voice and lyric data.
FIG. 3B is a graph showing an example of a pitch feature analysis result.
FIG. 3C is a graph showing an example of a dynamics feature analysis result.

The input singing voice audio signal analysis section 5 executes step ST2. The input singing voice audio signal analysis section 5 analyzes the pitch, dynamics, voiced-sound segment, and vibrato segment of the audio signal of input singing voice as features, and stores a result of the analysis in the analyzed data storage section 7. The vibrato segment needs not be analyzed as a feature, when an off-pitch amount estimating section 17, a pitch compensating section 19, a pitch transposing section 21, a vibrato adjusting section 23, and a smoothing section 25, which will be described later, are not provided. Any input singing voice audio signal analysis section capable of analyzing (extracting) the features of the audio signal of input singing voice may be used as the input singing voice audio signal analysis section 5 in this embodiment. The input singing voice audio signal analysis section 5 in this embodiment has the following four functions: a first function of estimating a fundamental frequency Fo from the audio signal of input singing voice in a predetermined cycle, monitoring the pitch of the audio signal of input singing voice based on the fundamental frequency Fo, and then storing the monitored pitch in the analyzed data storage section 7 as pitch feature data on the audio signal of input singing voice; a second function of estimating a voiced sound property from the audio signal of input singing voice, monitoring a segment in which the voiced sound property is higher than a predetermined threshold value as the voiced segment of the audio signal of input singing voice, and storing the voiced segment in the analyzed data storage section 7; a third function of monitoring the dynamics feature of the audio signal of input singing voice and then storing the monitored dynamics feature in the analyzed data storage section 7 as dynamics feature data; and a fourth function of monitoring a segment where a vibrato is present from the pitch feature data and then storing the segment with the vibrato in the analyzed data storage section 7 as the vibrato segment. The fundamental frequency Fo may be estimated by using an arbitrary estimation method. A method of estimating the fundamental frequency Fo from singing without accompaniment may be employed, or a method of estimating the fundamental frequency Fo from singing with accompaniment may be employed. FIG. 3A shows an example of the audio signal of input singing voice and an example of the lyric data. FIG. 3B shows an example of a result of analysis of the pitch feature. A unit on the vertical axis in FIG. 3B corresponds to a note number compliant with the MIDI standard which will be described later. In FIG. 3B, the voiced segment is shown below the pitch. The voiced segment is the segment in which a voiced sound is present. A segment other than the voiced segment is a non-voiced segment. FIG. 3C shows an example of the feature of the analyzed dynamics. A unit on the vertical axis in FIG. 3C may be an arbitrary unit representing the dynamics, because the unit on the vertical axis should indicate the dynamics that is only significant as a relative value (indicating a relative variation). For detection of the vibrato, any of known methods of detecting the vibrato may be adopted. FIG. 3B shows the vibrato segment in which the vibrato is detected. In the vibrato segment, the pitch changes periodically. This periodic pitch change is not seen in the other segments.

The pitch parameter estimating section 9 executes step ST3 in FIG. 2. The pitch parameter estimating section 9 estimates the pitch parameter, by which the pitch feature of the audio signal of input singing voice is got close to the pitch feature of the audio signal of synthesized singing voice, with the dynamics parameter kept constant, based on the pitch feature of the audio signal of input singing voice read from the analyzed data storage section 7 and the lyric data having the specified syllable boundaries stored in the lyric data storage section 15. Then, based on the pitch parameter estimated by the pitch parameter estimating section 9, the singing synthesis section 101 synthesizes temporary singing synthesis parameter data estimated by the singing synthesis parameter data estimating section 13, thereby obtaining a temporary audio signal of synthesized singing voice. The temporary singing synthesis parameter data estimated by the singing synthesis parameter data estimating section 13 is stored in the singing synthesis parameter data storage section 105. Accordingly, the singing synthesis section 101 synthesizes and outputs the temporary audio signal of synthesized singing voice according to an ordinary synthesis operation, based on the temporary singing synthesis parameter data and the lyric data. The pitch parameter estimating section 9 repeats estimation of the pitch parameter until the pitch feature of the temporary audio signal of synthesized singing voice reaches a pitch feature close to the pitch feature of the audio signal of input singing voice. A method of estimating the pitch parameter will be described, in detail, later. The pitch parameter estimating section 9 in this embodiment includes a function of analyzing the pitch feature of the temporary audio signal of synthesized singing voice output from the singing synthesis section 101, like the input singing voice audio signal analyzing section 5. Then, the pitch parameter estimating section 9 in this embodiment repeats estimation of the pitch parameter predetermined times (specifically four times). The pitch parameter estimating section 9 may be of course configured to repeat estimation of the pitch parameter until the pitch feature of the temporary audio signal of synthesized singing voice converges to the pitch feature of the audio signal of input singing voice, rather than repeat estimation the predetermined number of times. Assume that estimation of the pitch parameter is repeated as in this embodiment. Then, even if sound source data differs, or even if the synthesis method of the singing synthesis section 101 differs, the pitch feature of the temporary audio signal of synthesized singing voice automatically reaches a pitch feature close to the pitch feature of the audio signal of input singing voice whenever the estimation is repeated. Thus, the quality and accuracy of synthesis of the singing synthesis section 101 is enhanced.

After estimation of the pitch parameter has completed, the dynamics parameter estimating section 11 executes step ST4 shown in FIG. 2. The dynamics parameter estimating section 11 converts the dynamics feature of the audio signal of input singing voice to a relative value with respect to the dynamics feature of the audio signal of synthesized singing voice and estimates the dynamics parameter, by which the dynamics feature of the audio signal of synthesized singing voice is got close to the dynamics feature of audio signal of input singing voice that has been converted to the relative value. The singing synthesis parameter data estimating section 13 stores in the singing synthesis parameter data storage section 105 temporary singing synthesis parameter data estimated based on the pitch parameter completely estimated by the pitch parameter estimating section 9 and the dynamics parameter estimated by the dynamics parameter estimating section 11. The singing synthesis section 101 synthesizes the temporary singing synthesis parameter data, and outputs a temporary audio signal of synthesized singing voice. The dynamics parameter estimating section 11 repeats estimation of the dynamics parameter predetermined times until the dynamics feature of the temporary audio signal of synthesized singing voice reaches a dynamics feature close to the dynamics of the audio signal of input singing voice that has been converted to the relative value. The dynamics parameter estimating section 11 includes a function of analyzing the dynamics feature of the temporary audio signal of synthesized singing voice output from the singing synthesis section 101, like the input singing voice audio signal analyzing section 5. Then, the dynamics parameter estimating section 11 in this embodiment repeats estimation of the dynamics parameter predetermined times (specifically, four times). The dynamics parameter estimating section 11 may be of course configured to repeat estimation of the dynamics parameter until the dynamics feature of the temporary audio signal of synthesized singing voice converges to the dynamics feature of the audio signal of input singing voice that has been converted to the relative value. When estimation of the dynamics parameter is repeated as in the estimation of the pitch parameter, the accuracy of the estimation of the dynamics parameter may be more increased.

Then, the singing synthesis parameter data estimating section 13 executes step ST5 in FIG. 2. The singing synthesis parameter data estimating section 13 generates singing synthesis parameter data based on the estimated pitch parameter and the estimated dynamics parameter, and then stores the estimated singing synthesis parameter data in the singing synthesis parameter data storing section 105.

After the pitch parameter is changed, the dynamics parameter is also changed. However, there is scarcely a singing synthesis system where the pitch parameter is also changed after the dynamics parameter is changed. For this reason, if the dynamics parameter is estimated after estimation of the pitch parameter as in this embodiment, there is no need to estimate the pitch parameter again. Consequently, according to this embodiment, singing voice parameter data may be easily generated in a short time. However, in the case of an exceptional singing synthesis system where the pitch parameter is also changed after the dynamics parameter is changed, it is necessary to estimate the dynamics parameter after estimation of the pitch parameter and then estimate the pitch parameter again.

Figure 4:
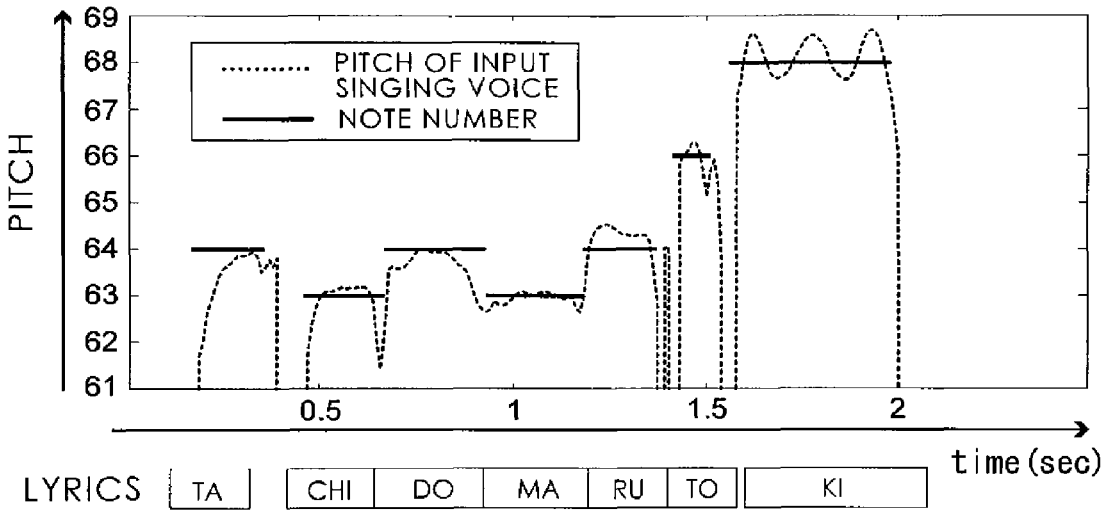
FIG. 4 is a graph for explaining a concept when a note number is determined.
Figure 5:
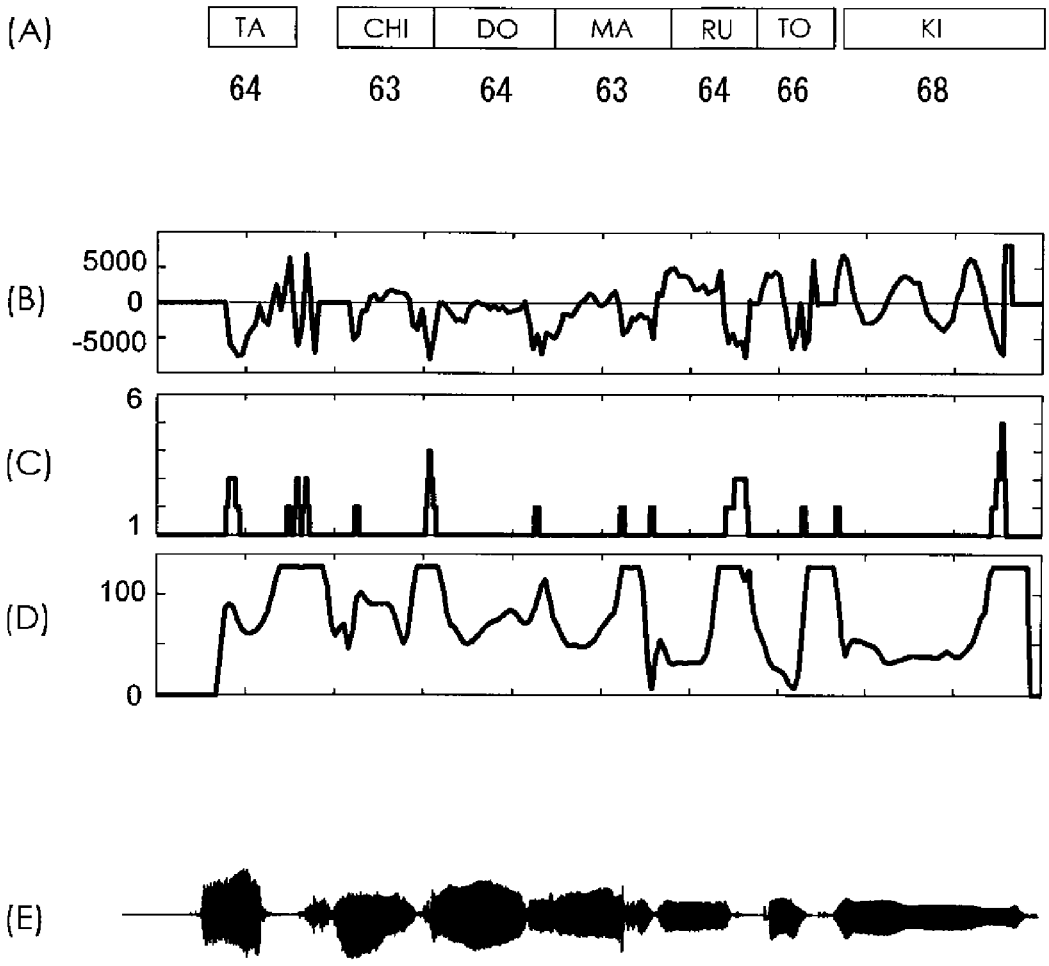
FIGS. 5A to 5E are diagrams used for explaining a pitch parameter.

Any pitch parameter estimated by the pitch parameter estimating section 9 may be used, if the pitch parameter can represent a variation in pitch. In this embodiment, the pitch parameter is constituted from a parameter element indicating a reference pitch level for each of signals in a plurality of partial segments of the audio signal of input singing voice, a parameter element indicating a temporal relative pitch variation of each of the signals in the partial segments with respect of the reference pitch level, and a parameter element indicating a variation width of each of the signals in the partial segments in a pitch direction. The partial segments respectively correspond to a plurality of syllables in lyric data. Specifically, the parameter element indicating the reference pitch level is a note number compliant with the MIDI standard or the note number of a commercially available singing synthesis system. FIG. 4 illustrates a concept that is considered when the note number is determined. Referring to FIG. 4, the "pitch of input singing voice" means the pitch of an audio signal of input singing voice. Then, FIG. 5A shows an example where the reference pitch level for each of the signals in the partial segments of the audio signal of input signal voice is represented by the note number. For example, numbers "64" and "63" below syllables "ta" and "chi" are the note numbers. The note numbers represent the pitches using numbers (integers) that differ to each other by one for each semitone difference in the pitches, and are respectively represented by figures 0 to 127. Keys correspond to note numbers of the integers and may be treated as real numbers on a same scale when the keys are regarded as units. The note numbers of the integers that are incremented by one from a lowest key are assigned to respective piano keys, for example. A pitch difference of one octave corresponds to a note number difference of 12. In this embodiment, as the parameter element that indicates the temporal relative variation of the pitch (represented by a real number using the unit of the note number) with respect to the reference pitch level (indicated by the note number of an integer), a pitch bend (PIT) is used. The pitch bend (PIT) is compliant with the MIDI standard or commercially available singing synthesis system. The pitch bend (PIT) is represented by an integer in the range of −8192 to 8191. FIG. 5B shows an example of the pitch bend (PIT). The center line of the graph showed in FIG. 5B corresponds to the reference pitch level (note number) in each syllable. The value of the note number differs for each syllable. The note number values are plotted on a straight line, and the pitch bend (PIT) is shown as a relative value for the straight line. In this embodiment, as the parameter element that indicates the variation width in the pitch direction, a pitch bend sensitivity (PBS) is used. The pitch bend sensitivity (PBS) is compliant with the MIDI standard or commercially available singing synthesis system. FIG. 5C shows an example of the pitch bend sensitivity (PBS). The pitch bend sensitivity (PBS) is normally 1. If a variation in pitch is large, the pitch bend sensitivity (PBS) assumes two, three, or the like. The maximum value of the pitch bend sensitivity is 24. The smaller pitch bend sensitivity (PBS) is desirable, if not necessary. This is because with the smaller pitch bend sensitivity (PBS), frequency resolution that indicates the pitch is improved.

Figure 6:
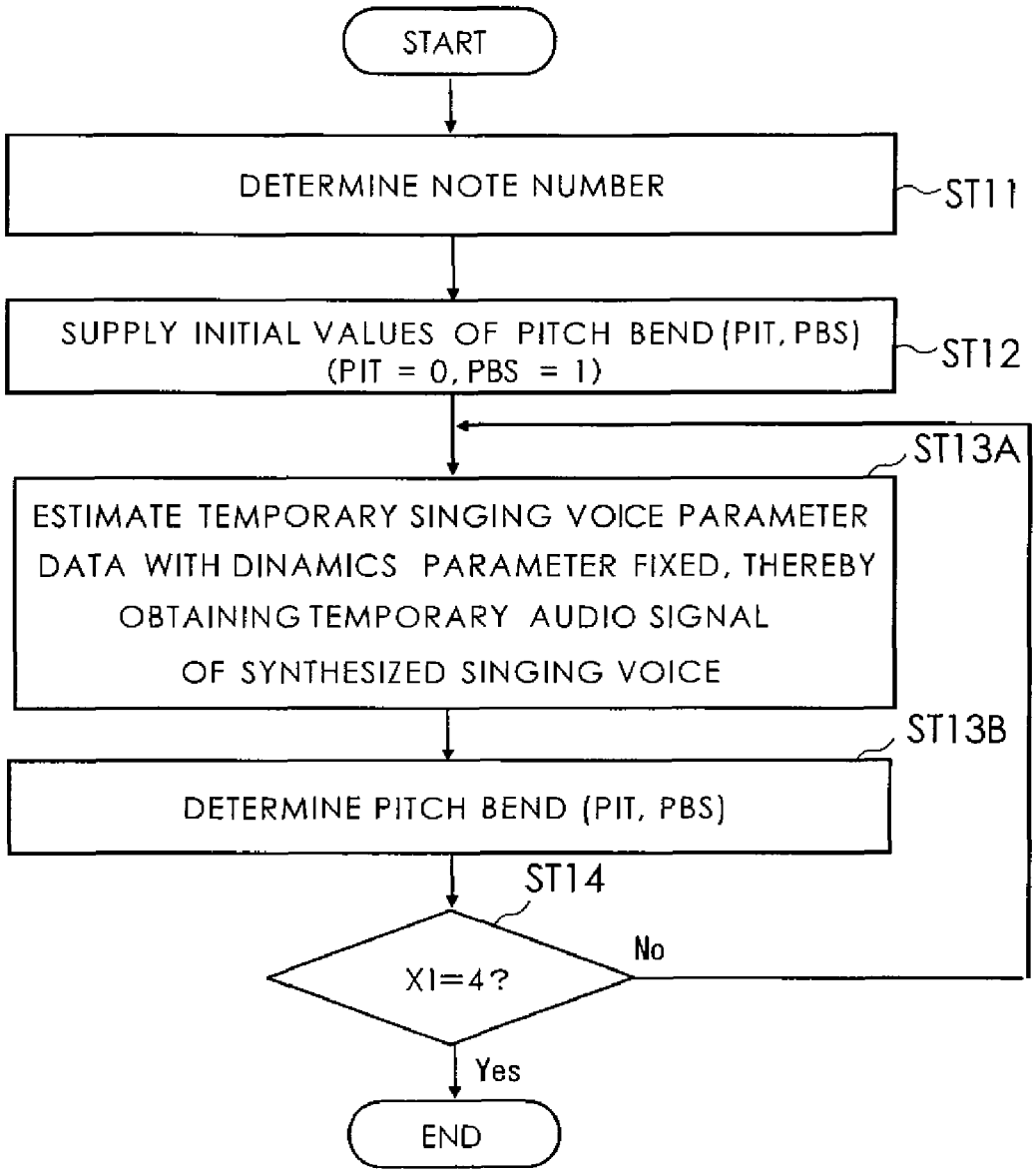
FIG. 6 is a flowchart showing an algorithm of a program used when a pitch parameter estimating section is implemented by the computer.

When the pitch parameter is constituted from the three parameter elements in this manner, the pitch parameter estimating section 9 may estimate these parameter elements in the following manner. FIG. 6 shows an algorithm of a program used when the pitch parameter estimating section 9 is implemented by the computer. First, in step ST11, the note number is determined as the parameter element representing the reference pitch level. As shown in FIG. 4, similarity between the pitch feature of the audio signal of the input singing voice in a segment from the start end to the finish end of each syllable and each of the note numbers of 0 to 127 is calculated. Then, the note number having the largest similarity for each syllable is determined as the corresponding note number.

Then, in step ST 12, predetermined the initial value of the parameter element [pitch bend (PIT)] indicating the temporal relative pitch variation and the initial value of the parameter element [pitch bend sensitivity (PBS)] indicating the variation width in the pitch direction are set. In this embodiment, the pitch bend (PIT) of zero and the pitch bend sensitivity (PBS) of one are set as the initial values. Next, in step ST13, steps ST13A and ST13B are repetitively executed, with the note numbers and the dynamics parameter fixed. First, in step ST13A, the temporary singing synthesis parameter data is estimated, based on the initial values, and the temporary singing synthesis parameter data is synthesized by the singing synthesis section, thereby obtaining the temporary audio signal of synthesized singing voice. Then, in step ST13B, the parameter element (PIT) indicating the temporal relative pitch variation and the parameter element (PBS) indicating the variation width in the pitch direction are estimated so that the pitch feature of the temporary audio signal of synthesized singing voice reaches the pitch feature close to the feature of the audio signal of input singing voice. Then, based on the estimated parameter elements (PIT, PBS), next temporary singing synthesis parameter data is estimated until the number of estimation times X1 reaches four. Then, the operation of estimating the parameter element (PIT) indicating the temporal relative pitch variation and the parameter element (PBS) indicating the variation width in the pitch direction (in steps ST13A and 13B) again is repeated so that the pitch feature of a next temporary audio signal of synthesized singing voice resulting from synthesis by the singing synthesis section reaches a pitch feature close to the pitch feature of the audio signal of input singing voice.

The pitch bend (PIT) and the pitch bent sensitivity (PBS) at a (current) time of estimation are converted to a real number value Pb corresponding to the note number according to Expression 12 which will be described later, in order to estimate (determine) the pitch bend (PIT) and the pitch bend sensitivity (PBS) after their initial values have been supplied. Next, the pitch feature of the temporary audio signal of synthesized singing voice is estimated. Then, a difference between the pitch feature of the audio signal of input singing voice and the pitch feature of the temporary audio signal of synthesized singing voice is determined, and this difference is added to the real number value Pb. Then, based on the real number value Pb to which the pitch feature difference has been added, the pitch bend (PIT) and the pitch bend sensitivity (PBS) are determined so that the pitch bend sensitivity is reduced. This operation is repeated four times in this embodiment.

With this arrangement, after the reference pitch level (note number) has been first determined, the remaining two parameter elements (PIT, PBS) should be iteratively estimated. Thus, estimation of the parameter elements is facilitated, and the pitch parameter may comprise the three parameter elements. If the number of estimation times X1 has reached four in step ST14, the estimation is finished. The number of estimation times X1 may be set to an integer value other than four.

Figure 7:
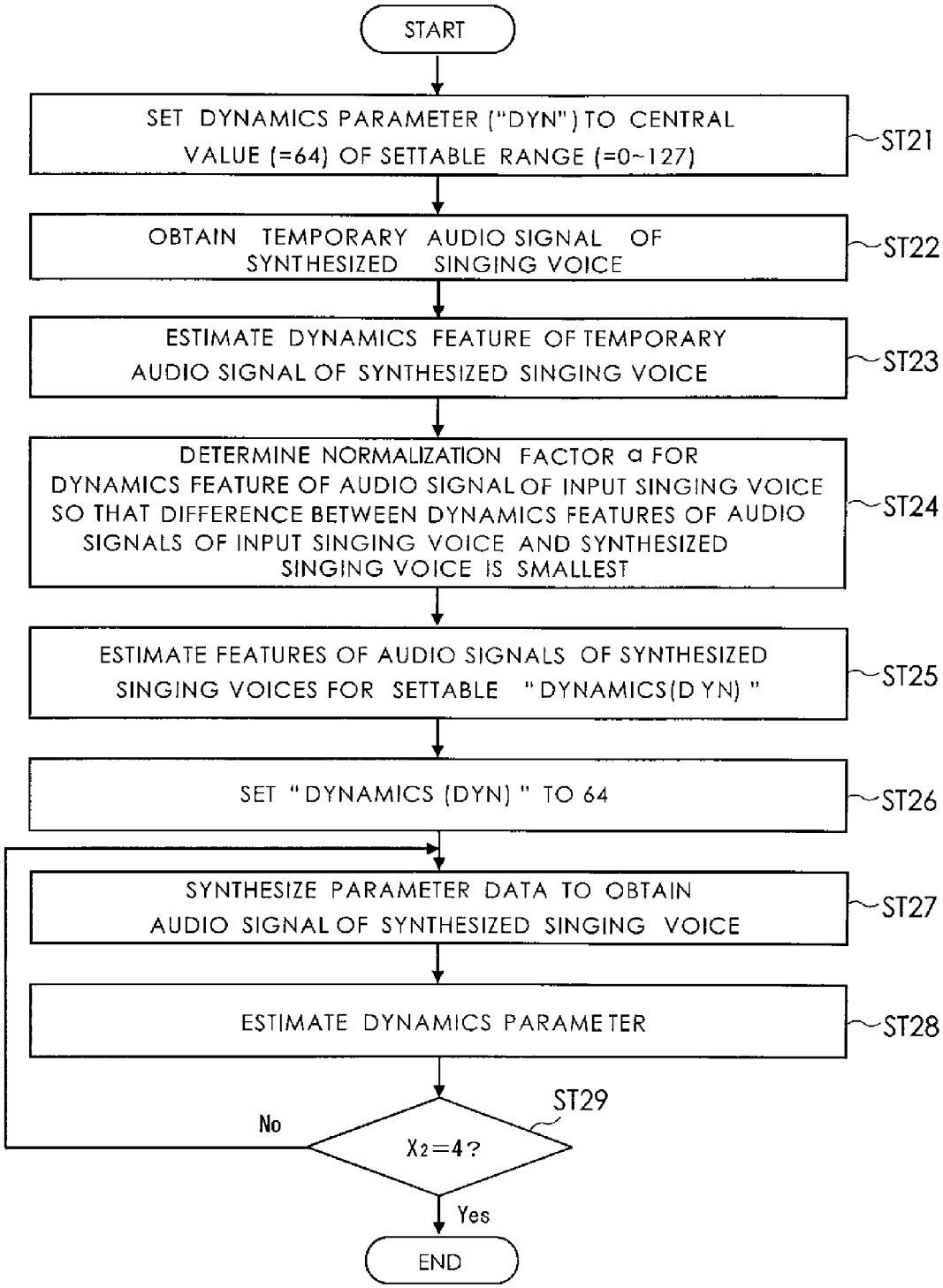
FIG. 7 is a flowchart showing an algorithm of a program used when a dynamics parameter estimating section is implemented by the computer.

FIG. 7 is a flowchart showing an algorithm of a program used when the dynamics parameter estimating section 11 is implemented by the computer. Due to this algorithm, the dynamics parameter estimating section 11 has the following two functions for estimation of the dynamics parameter. One is the function of determining a normalization factor $\alpha$ so that a distance between the dynamics feature of a temporary audio signal of synthesized singing voice resulting from synthesis of temporary singing synthesis parameter data by the singing synthesis section and the feature of the dynamics of the audio signal of input singing voice is the smallest. The temporary singing synthesis parameter data is estimated based on the completely estimated pitch parameter and the dynamics parameter set to the center of a settable dynamics parameter range. The other is the function of converting the dynamics feature of the audio signal of input singing voice to the relative value by multiplication of the dynamics of the audio signal of input singing voice by the normalization factor $\alpha$. With these two functions, even if the dynamics feature of the audio signal of input singing voice is significantly larger or significantly smaller than the dynamics feature of the temporary audio signal of synthesized singing voice resulting from synthesis by the singing synthesis section 101, the dynamics parameter may be appropriately estimated by relative value conversion. In this embodiment, an expression compliant with the MIDI standard or "dynamics (DYN)" of the commercially available singing synthesis system is employed as the dynamics parameter.

With reference to the flowchart in FIG. 7, in step ST21, the dynamics parameter (DYN) is set to a central value (64) in a settable range (0 to 127). In other words, the dynamics parameter in each segment is set to the central value (64). The settable range (0 to 127) of the dynamics parameter (DYN) indicates the range of a dynamics level that may be set, and is not related to the note numbers 0 to 127. Then, in step ST22, the completely estimated pitch parameter and the dynamics parameter that has been set to the central value are synthesized by the singing synthesis parameter data estimating section 13, thereby estimating temporary singing synthesis parameter data. The temporary singing synthesis parameter data is synthesized by the singing synthesis section 101, thereby obtaining a temporary audio signal of synthesized singing voice. Next, in step ST23, the dynamics feature of the temporary audio signal of synthesized singing voice is estimated as in analysis at the input singing voice signal analysis section 5. Next, in step ST24, the normalization factor $\alpha$ for converting the dynamics feature of the audio signal of input singing voice is determined so that the distance (distance in overall segments) between the dynamics feature of the audio signal of input singing voice and the dynamics feature of the temporary audio signal of synthesized singing voice is the smallest.

Figure 8:
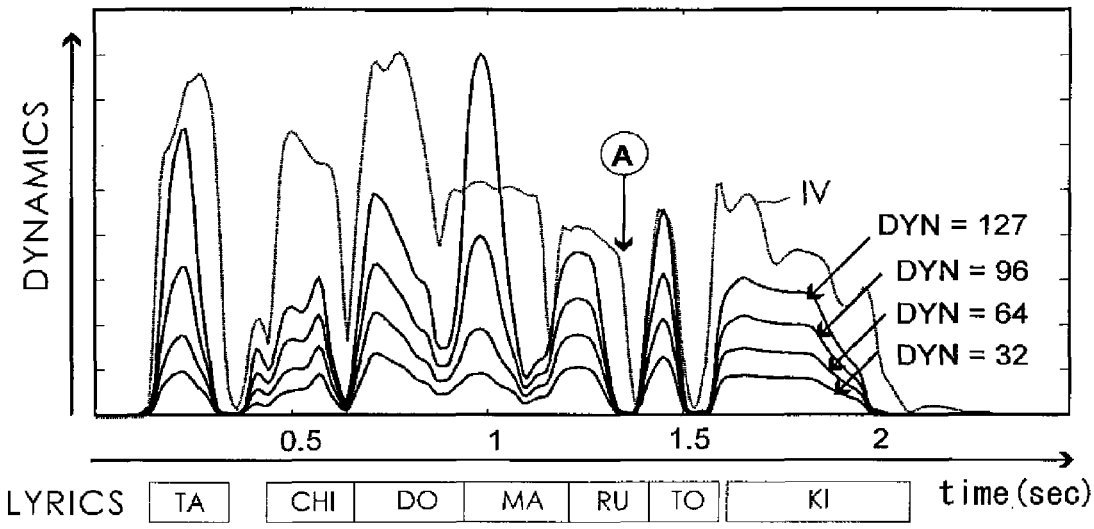
FIG. 8 comprises graph showing a result of estimating dynamics features from four temporary audio signals of synthesized singing voices obtained for "dynamics DYN" of 32, 64, 96, and 127.

After the normalization factor $\alpha$ has been determined, data when dynamics features of temporary audio signals of synthesized singing voices have been obtained for all of "settable dynamics (DYN)" from 0 to 127 is acquired in step 25, with the normalization factor $\alpha$ fixed. A process that estimates the dynamics features of the temporary audio signals of synthesized singing voices may be performed for all the settable "dynamics (DYN)" from 0 to 127. However, by doing so, the amount of the process is increased. Then, in this embodiment, for "the dynamics DYNs" of 0, 32, 64, 96, and 127, the temporary audio signals of synthesized singing voices are respectively obtained, and then, the dynamics features of the acquired five types of the temporary audio signals of synthesized singing voices are obtained. The dynamics features of the temporary audio signals of synthesized singing voices for "the dynamics DYN" other than "the DYN" of 0, 32, 64, 96, and 127 are respectively estimated using linear interpolation. The dynamics features of the audio signals of synthesized singing voices for "the dynamics DYN" of 0 to 127 thus obtained are used for estimating the dynamics parameter. FIG. 8 shows a result of respectively obtaining the temporary audio signals of synthesized singing voices for the dynamics DYN of 32, 64, 96, and 127 and then estimating the dynamics features from the temporary audio signals of synthesized singing voices. Referring to FIG. 8, data represented by a sign IV indicates the dynamics feature analyzed from the audio signal of input singing voice. In the state shown in FIG. 8, the dynamics feature of each syllable analyzed from the audio signal of the input singing voice is often larger than the dynamics feature of the audio signal of synthesized singing voice, if the dynamics DYN" is 127. Then, in this embodiment, the dynamics feature analyzed from the audio signal of input singing voice is multiplied by the normalization factor $\alpha$ thereby reducing the dynamics feature of the audio signal of input singing voice to a level at which the dynamics parameter may be estimated.

In step ST26, "the dynamics (DYN)" for obtaining the initial value of the dynamics feature of the temporary audio signal of synthesized singing voice is set to 64 (intermediate value). Then, the operation proceeds to step ST27. In step ST27, using the completely estimated pitch parameter and the dynamics parameter for which "the dynamics (DYN)" has been set to 64, the singing synthesis parameter data is estimated by the singing synthesis parameter data estimating section 13. The temporary audio signal of synthesized singing voice is thereby obtained by the singing synthesis section 101. Then, in step ST28, first-time estimation of "the dynamics" as the dynamics parameter is performed.

Figure 9:
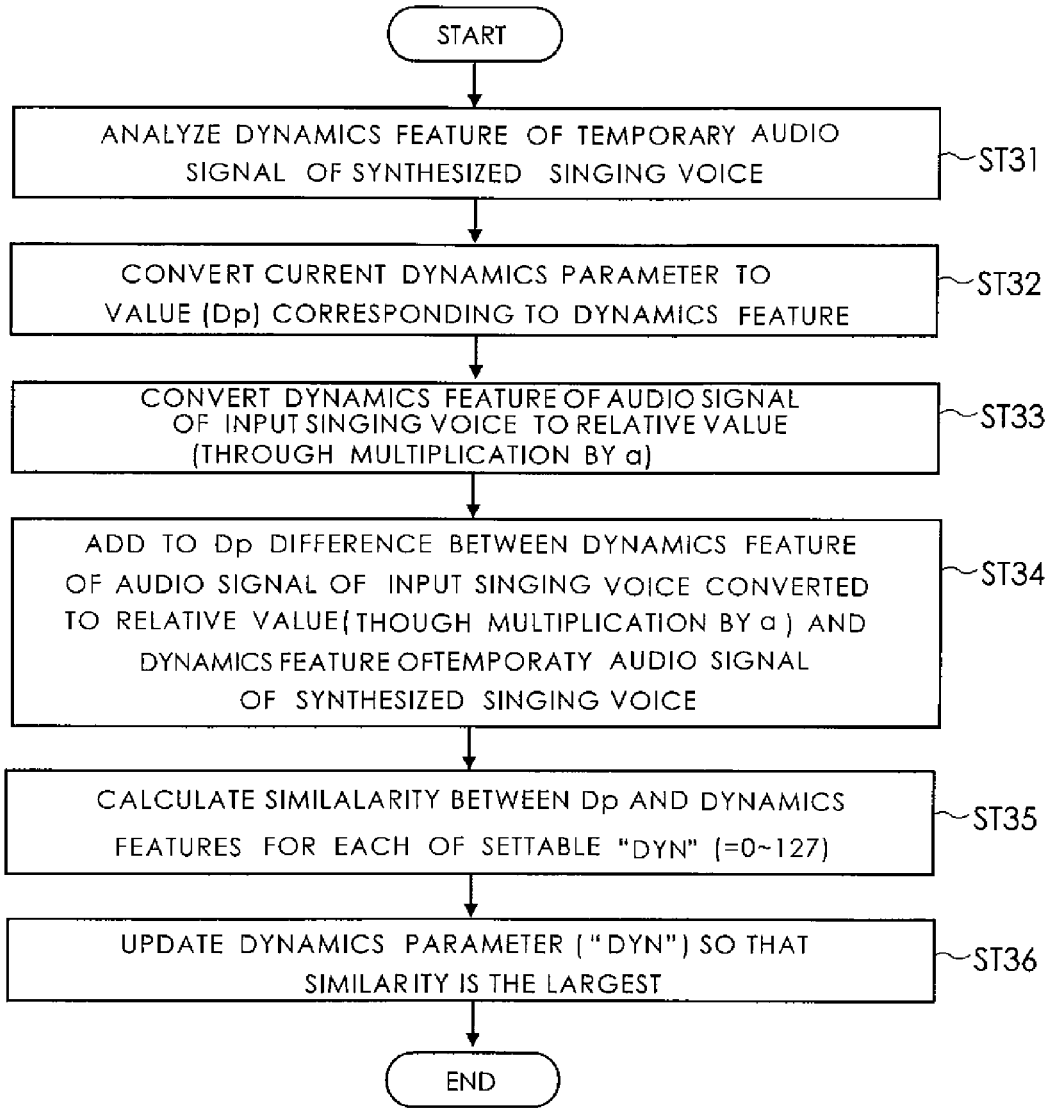
FIG. 9 is a flowchart showing an algorithm of a program used when a dynamics parameter is estimated by the computer.

The estimation in step ST28 is executed according to an algorithm in FIG. 9. In step ST31 in FIG. 9, the dynamics feature of the temporary audio signal of synthesized singing voice obtained in step ST27 is first analyzed. Then, in step ST32, using relationships between the dynamics features of the temporary audio signals of synthesized singing voices at all "the DYNs" of 0 to 127, the current dynamics parameter given by "the dynamics" is converted to a real number value (Dp) corresponding to the dynamics feature of the audio signal of input singing voice. Next, in step ST33, the dynamics feature of the audio signal of input singing voice is multiplied by the normalization factor $\alpha$, thereby converting the dynamics feature of the audio signal of input singing voice to the relative value. Next, in step ST34, a difference between the dynamics of the audio signal of input singing voice that has been converted to the relative value and the dynamics feature of the temporary audio signal of synthesized singing voice is added to the real number value (Dp), thereby obtaining another value (Dp'). Then, in step ST35, a similarity (distance) between the new value (Dp') and the dynamics feature of the temporary audio signal of synthesized singing voice for each of "the dynamics DYN" of 0 to 127 is computed. In step ST36, the dynamics parameter ("dynamics") for each syllable is determined so that the computed similarity (distance) is the maximum (minimum).

The dynamics feature (IV) of the audio signal of input singing voice shown in FIG. 8 as a whole is converted to the relative value, and most of the dynamics features of the respective syllables of the audio signal of input singing voice falls within a range where the dynamics feature of the temporary audio signal of synthesized singing voice for each of "the DYN" of 0 to 127 ("DYN" of 32, 64, 96, and 127 in FIG. 8) is present. Then, the dynamics parameter ("dynamics") for each syllable is estimated so that the dynamics feature of the temporary audio signal of synthesized singing voice obtained by the current parameter reaches a dynamics feature close to the dynamics feature of the audio signal of input singing voice that has been converted to the relative value. In this embodiment, after four times of repetition of steps ST 27 to ST 28 in FIG. 7, estimation of the dynamics parameter is completed. The number of estimation times may be set to an integer value other than four.

Referring back to FIG. 1, when lyric data with specified syllable boundaries is used, the data is directly stored in the lyric data storage section 15. However, lyric data without specified syllable boundaries is supplied for generation of the singing synthesis parameter data, the lyric alignment section 3 generates the lyric data having specified syllable boundaries, based on the lyric data without specified syllable boundaries and the audio signal of input singing voice. If the lyric alignment section 3 is provided as in this embodiment, lyric data having specified syllable boundaries may be readily provided in the singing synthesis parameter data estimation system even if lyric data without specified syllable boundaries is supplied.

Figure 10:
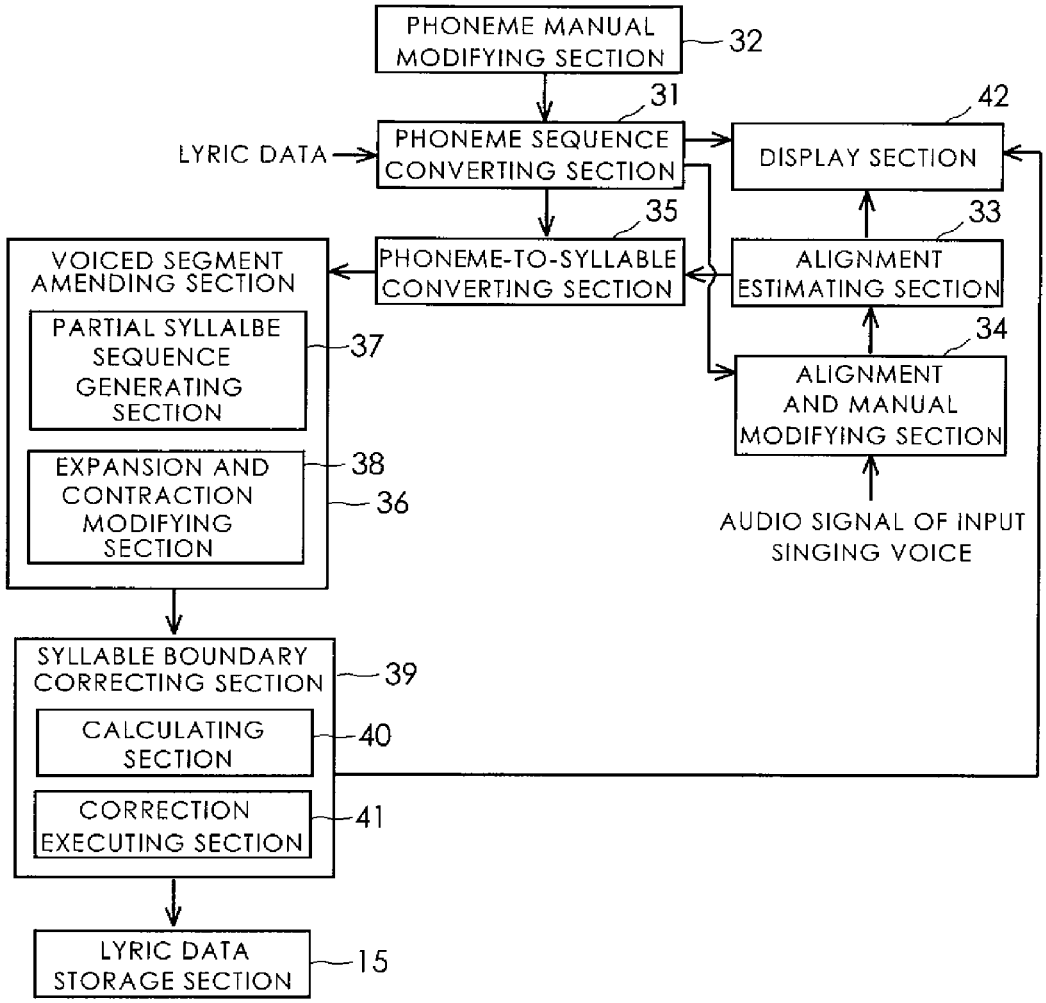
FIG. 10 is a block diagram showing a configuration of a lyric alignment section.
Figure 11:
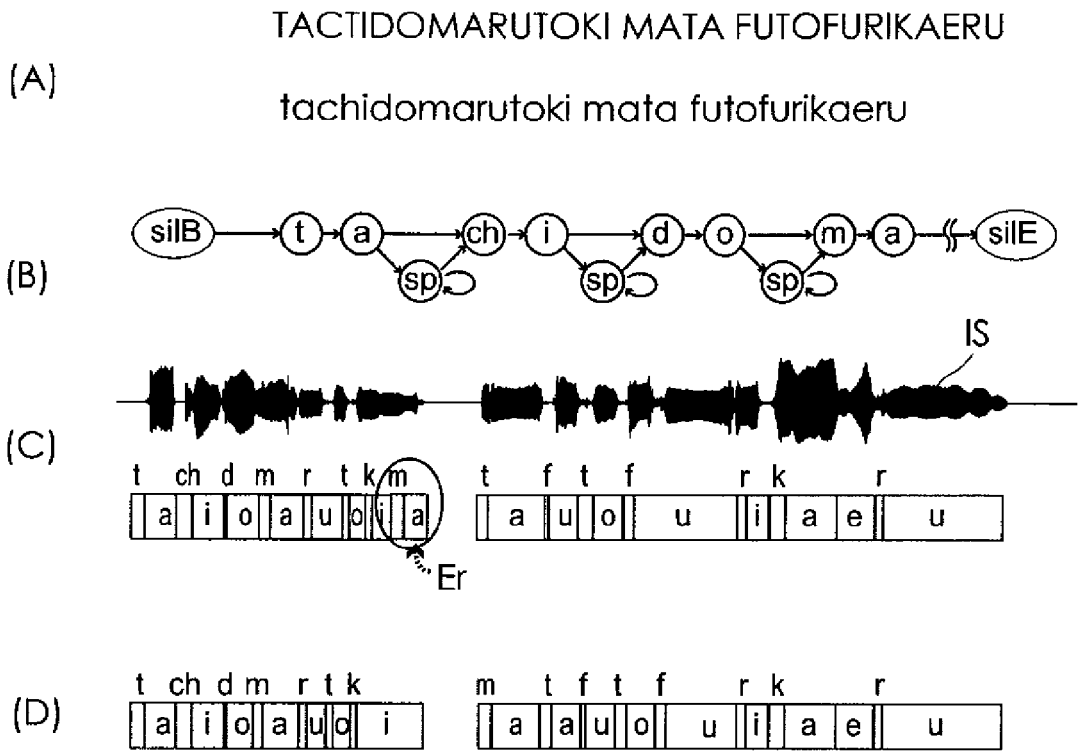
FIGS. 11A to 11D are diagrams used for explaining lyric alignment.

The lyric alignment section may be arbitrarily configured. FIG. 10 shows a configuration of the lyric alignment section 3 in this embodiment. The lyric alignment section 3 includes a phoneme sequence converting section 31, a phoneme manual modifying section 32, an alignment estimating section 33, an alignment and manual modifying section 34, a phoneme-to-syllable sequence converting section 35, a voiced segment amending section 36, a syllable boundary correcting section 39, and a lyric data storage section 15. The phoneme sequence converting section 31 converts, lyrics included in the lyric data without specified syllable boundaries, into a phoneme sequence composed of a plurality of phonemes (which is morphological analysis), as shown in FIG. 11A. In the example in FIG. 11A, lyric data displayed above in the form of "hiragana" is converted into a phoneme sequence displayed below in the form of alphabets.

The phoneme manual modifying section 32 allows the users to modify manually a result of conversion in the phoneme sequence converting section 31. The phoneme sequence obtained by the conversion is displayed on a display section 42 such as a monitor of a personal computer in order to perform modification. The user operates an input section such as a keyboard of the personal computer, thereby modifying a phoneme error in the phoneme sequence displayed on the display section 42.

The alignment estimating section 33 first estimates an alignment grammar as shown in FIG. 11B. In an example of the alignment grammar shown in FIG. 11B, a short pause sp corresponding to no sound is arranged between syllables. The alignment grammar may be arbitrarily set, based on known speech recognition technology. Then, the alignment estimating section 33 estimates a start time and a finish time of each of the phonemes included in the phoneme sequence in an audio signal IS of input singing voice, as shown in FIG. 11C and displays a result of the estimation on the display section 42. For example, this alignment may employ a Virterbi alignment technique used in the speech recognition technology.

FIG. 11C displays an example of the estimation result displayed on the display section 42. In this example, a plurality of blocks arranged laterally respectively correspond to the phonemes, and an occurrence time at the front end of each block indicates the start time of the corresponding phoneme, and the rear end of the block indicates the finish time of the corresponding phoneme. In FIG. 11C, a consonant in the phoneme sequence are displayed above the corresponding block, while a vowel is displayed inside the corresponding block. In the example shown in FIG. 11C, an error that extends over two phrases (error in which the phoneme in a subsequent phrase erroneously enters into a preceding phrase) occurs in a phoneme "ma" indicated by reference character Er. Then, the alignment and manual modifying section 34 allows manual modification of the start time and the finish time of each of the phonemes included in the phoneme sequence estimated by the alignment estimating section 33. FIG. 11D shows a phoneme sequence after modification of the phoneme sequence shown in FIG. 11C. The alignment manual modifying section 34 performs the modifying operation of moving the error portion Er of the result of the estimation displayed on the display section 42 from the preceding phrase to the subsequent phrase when the user points out the error portion Er by a cursor or the like.

Figure 12:
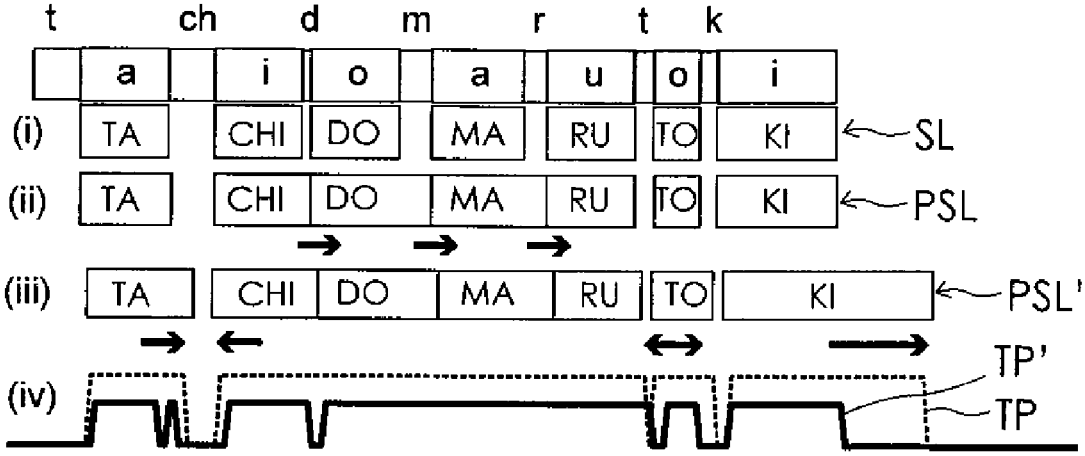
FIGS. 12*i* to 12*iv* are diagrams used for explaining amendment of a voiced segment deviation.

The phoneme-to-syllable sequence converting section 35 shown in FIG. 10 converts a phoneme sequence finally estimated by the alignment estimating section 33 into a syllable sequence. FIG. 12*i* conceptually shows a state where the phoneme sequence has been converted to the syllable sequence by the phoneme-to-syllable sequence converting section 35. A "consonant+vowel" or a vowel in a Japanese phoneme sequence in Japanese lyrics may be converted into one syllable. In this embodiment, the phoneme sequence is converted into a syllable sequence SL with its vowel portions converted into syllables, as shown in FIG. 12*i*. Then, in the system in this embodiment, a deviation of a voiced segment in the syllable sequence SL from an actual syllable in lyrics represented by an audio signal of input singing voice is amended and an error in a syllable boundary is corrected. In this embodiment, the voiced segment amending section 36 amends the deviation of the voiced segment in the syllable sequence SL output from the phoneme-to-syllable sequence converting section 35. Then, when the user manually points out the error in the syllable boundary, the syllable boundary correcting section 39 allows correction of the error in the syllable boundary in the syllable sequence where the deviation of the voiced segment has been amended by the voiced segment amending section 36.

The voiced segment amending section 36 comprises a partial syllable sequence generating section 37 and an expansion and contraction modifying section 38. The partial syllable sequence generating section 37 connects two or more syllables included in one voiced segment (refer to FIG. 3B and a voiced segment TP indicated by a broken line in FIG. 12*iv*) of the audio signal of input singing voice analyzed by the input singing voice audio signal analyzing section 5 shown in FIG. 1 and then stored in the analyzed data storage section 7, thereby generating a partially-connected syllable sequence PSL. Then, the expansion and contraction modifying section 38 extends or contracts the start time and the finish time of a plurality of syllables included in the partially-connected syllable sequence PSL so that a voiced segment TP' obtained by analysis of the temporary audio signal of synthesized singing voice (refer to the voiced segment TP' indicated by a solid line in FIG. 12*iv*) coincides with the voiced segment TP of the audio signal of input singing voice obtained by the analysis by the input singing voice audio signal analysis section 5 (refer to the voiced segment TP indicated by the broken line in FIG. 12*iv*).

The expansion and contraction modifying section 38 first obtains the note number described in FIG. 5A for each of syllables included in the partially-connected syllable sequence PSL in order to obtain the temporary audio signal of synthesized singing voice. As described above, the note number represents the reference pitch level expressed by a numeral, for each of the signals in the plurality of partial segments of the audio signal of input singing voice. The partial segments respectively correspond to the syllables in the partially-connected syllable sequence PSL. When the plurality of note numbers for the syllables in the partially-connected syllable sequence PSL are known, the temporary audio signal of synthesized singing voice may be generated by using the note numbers, one sound source data selected from the sound source database 103, and lyric data including the partially-connected phoneme sequence. Then, the expansion and contraction modifying section 38 generates the temporary audio signal of synthesized singing voice with the pitch parameter and the dynamics parameter kept constant. Next, the expansion and contraction modifying section 38 analyzes the temporary audio signal of synthesized singing voice, like the input singing voice audio signal analysis section 5 shown in FIG. 1, thereby determining the voiced segment TP' of the temporary audio signal of synthesized singing voice. The voiced segment TP' is determined in the same way as the voiced segment TP. After the voiced segment TP' of the temporary audio signal of synthesized singing voice has been determined in this manner, the voiced segment TP of the audio signal of input singing voice (refer to the voiced segment TP indicated by the broken line in FIG. 12*iv*) is contrasted with the voiced segment TP' obtained by analysis of the temporary audio signal of synthesized singing voice (refer to the voiced segment TP' indicated by the solid line in FIG. 12*iv*). When there is a deviation between the voiced segments TP and TP', a start time and a finish time of a plurality of the syllables included in the partially-connected syllable sequence PSL are extended or contrasted so that the voiced segment TP' coincides with the voiced segment TP. Arrows (→, ←) shown in FIG. 12*iv* indicate extending or contracting (shift) directions of the start time and the finish time of the plurality of the syllables in the partially-connected syllable sequence PSL. Amendment of the deviation of the voiced segment TP' becomes manifest in adjustment of the length of the block indicating each syllable, as shown in FIG. 12*iii*. The length of the block indicating the last syllable "ki" in FIG. 12*iii*, for example, is increased with amendment of the deviation of the voiced segment TP'. If the partial syllable sequence generating section 37 and the expansion and contraction modifying section 38 are provided, the deviation of the voiced segment TP' from the voiced segment TP may be automatically amended.

Figure 13:
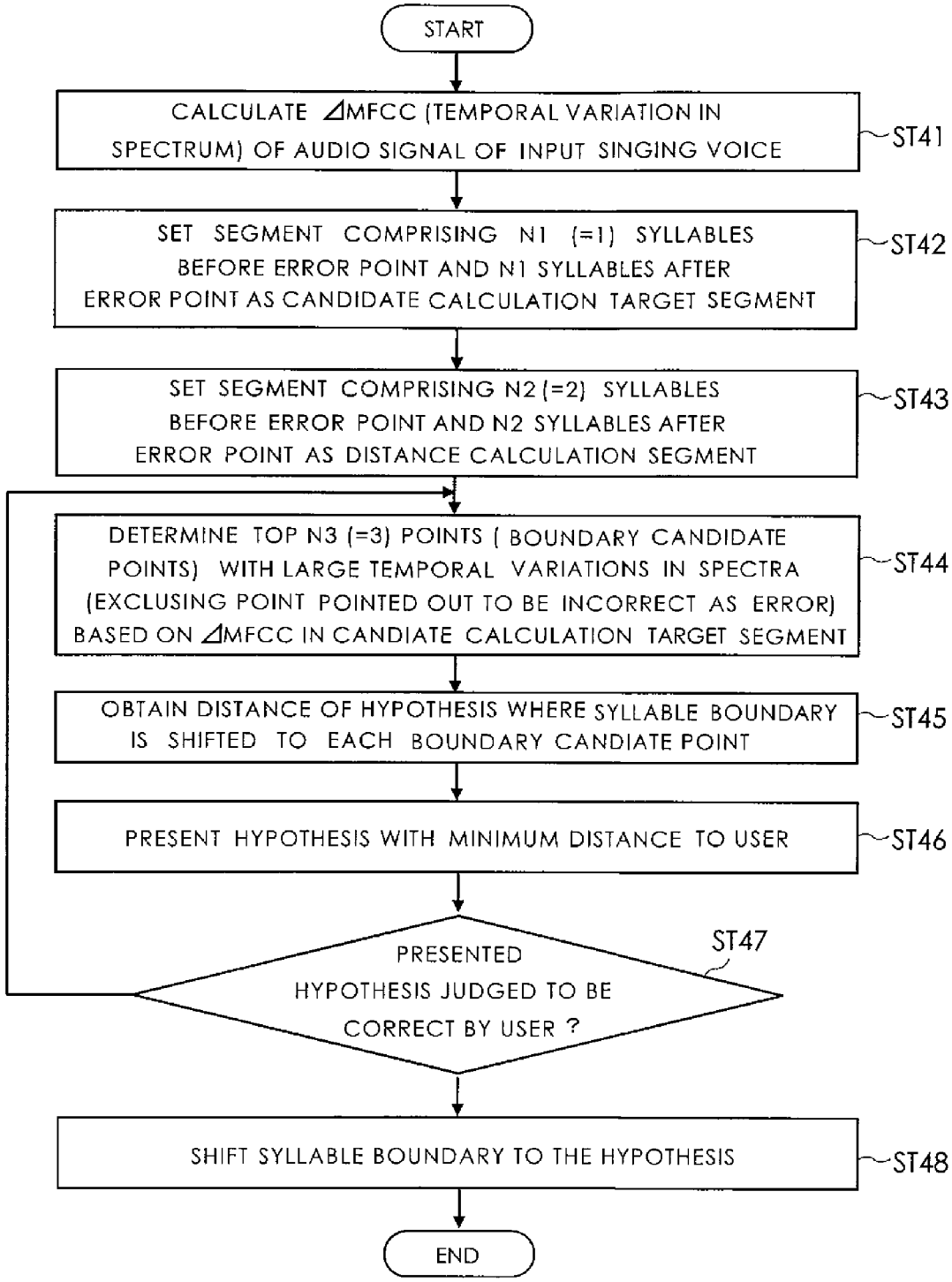
FIG. 13 is a flowchart showing an algorithm of a program when a syllable boundary correcting section is implemented by the computer.
Figure 14:
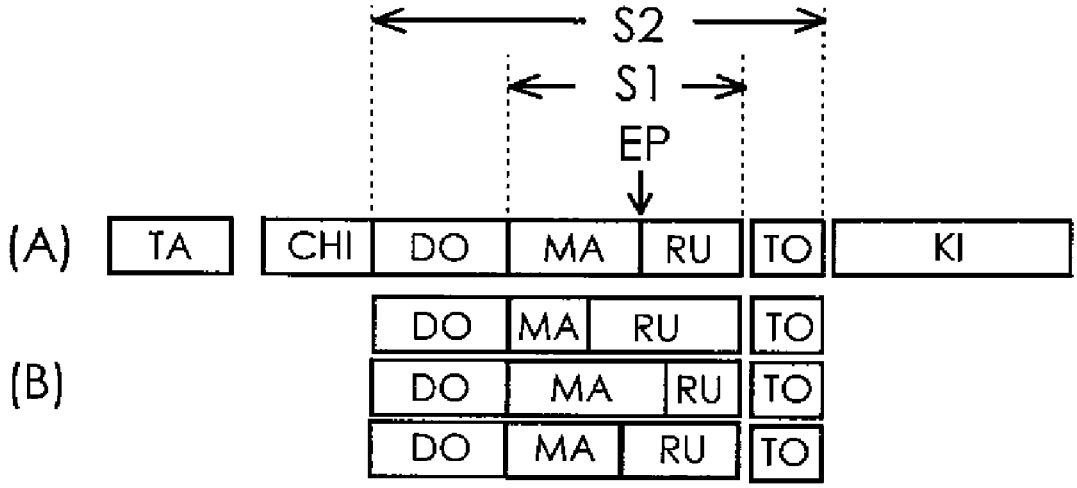
FIGS. 14A and 14B are diagrams used for explaining correction of a syllable boundary error.

The syllable boundary correcting section 39 corrects the syllable boundary error in the partially-connected syllable sequence PSL' where the deviation of the voiced segment TP' of the temporary audio signal of synthesized singing voice has been amended. As shown in FIG. 10, the syllable boundary correcting section 39 may comprise a calculating section 40 that calculates a temporal variation in the spectrum of the audio signal of input singing voice and a correction executing section 41. FIG. 13 is a flowchart of a program when the syllable boundary correcting section 39 is implemented by the computer. The correction executing section 41 executes correction through the user. As shown in step ST41 in FIG. 13, the calculating section 40 calculates a delta MFCC (Mel- Frequency Cepstrum Coefficient) of the audio signal of input singing voice, thereby calculating the temporal variation in the spectrum of the audio signal. The correction executing section 41 executes correction of the error in syllable boundary using the delta MFCC calculated by the calculating section 40, according to the following steps. The correction executing section 41 displays the partially-connected syllable sequence PSL' on the display section 42, as shown in FIG. 14A. When the user points out an error point EP on a screen of the display section 42, the correction executing section 41 sets a segment comprising N1 syllables before the error point EP and N1 syllables after the error point EP (N1 being a positive integer of one or more, and in this embodiment, N1 being one) to a candidate calculation target segment S1 in step ST42 in FIG. 13. Then, in step ST43, the correction executing section 41 sets a segment comprising N2 (N2 being a positive integer of one or more, and in this embodiment, N2 being two) syllables before the error section EP and N2 syllables after the error point EP to a distance calculation segment S2. Then, in step ST44, the correction executing section 41 determines N3 points with large temporal variations in spectra based on the temporal variation in the spectrum of the candidate calculation target segment S1 (N3 being a positive integer of one or more, and in this embodiment, N3 being three) as boundary candidate points. FIG. 14B shows examples of three boundary candidate points, from which an error point already pointed out to be an error (determined to be incorrect) is excluded. Next, in step ST45, a distance of a hypothesis where the syllable boundary is shifted to each boundary candidate point is obtained. For calculation of the distance of the hypothesis, the note number for each syllable in the distance calculation segment S2 is estimated, and the initial pitch bend (PIT) and the initial pitch bend sensitivity (PBS) set in advance are introduced, thereby estimating the pitch parameter. For estimation of the pitch parameter, a similar operation to the estimating operation of the pitch parameter estimating section 9 shown in FIG. 1 is performed. Then, using the pitch parameter obtained by the estimation and a constant dynamics parameter set in advance, a temporary audio signal of synthesized singing voice is generated. Then, the correction executing section 41 calculates the distance between the amplitude spectrum of the audio signal of input singing voice and the amplitude spectrum of the temporary audio signal of synthesized singing voice, for the overall distance calculation segment S2. The distance of the hypothesis in the distance calculation segment S2, where the syllable boundary is shifted to each of the three boundary candidate points shown in FIG. 14B, is calculated.

Then, in step ST46, the hypothesis having the minimum distance is presented. The presentation of the hypothesis is implemented by display of a syllable sequence on the display section 42 and reproduction of the temporary audio signal of synthesized singing voice by the audio playback device 107. Alternatively, the hypothesis may be presented by just one of the display and the reproduction. In step ST47, it is determined whether or not the presented hypothesis is judged to be correct or not by the user. If the user has not judged that the hypothesis is correct, the operation returns to step ST44, and then a next hypothesis is presented. If the user has judged that the hypothesis is correct, the operation proceeds to step ST48, and the syllable boundary is shifted, according to this hypothesis. The syllable boundary error is corrected in this manner. When the hypothesis of a portion for which automation of error correction is difficult is presented to call for judgment by the user as in this embodiment, the accuracy of correcting a syllable boundary error may be considerably increased. Further, when the spectral distance between the audio signal of input singing voice and the temporary audio signal of synthesized singing voice for the overall distance calculation segment is calculated as the distance of the hypothesis as in this embodiment, distance calculation which focuses attention on a spectral shape difference or a syllable difference may be performed. The temporal variation in spectrum may be of course represented by an indicator other than the delta Mel-Frequency Cepstrum Coefficient (ΔMFCC).

Music quality of an audio signal of input singing voice is not constantly guaranteed. There are some singing voices that are off-pitch or have strange vibrato. Further, in many cases, there is a difference in key between male and female singing voices. Then, in order to cope with such situations, this embodiment comprises an off-pitch amount estimating section 17, a pitch compensating section 19, a pitch transposing section 21, a vibrato adjusting section 23, and a smoothing section 25. In this embodiment, using these sections, the audio signal of input singing voice is edited, thereby expanding expression of input singing voice. Specifically, the following two types of alteration functions may be implemented. These alteration functions should be used according to the situation, and these alteration functions may not be used.

(A) Pitch Alteration Function

Off-pitch correction: an off-pitch sound is modified.

Pitch Transposition: singing in a voice region that cannot be sung by the user is synthesized.

(B) Singing Style Alteration Function

Vibrato Extent Adjustment: a user's favorite expression may be obtained by an intuitive operation of increasing or reducing the intensity of a vibrato.

Pitch and Dynamics Smoothing: overshoot and fine fluctuation of the pitch and the like may be restrained.

The off-pitch amount estimating section 17 estimates an off-pitch amount from pitch feature data in consecutive voiced segments of the audio signal of input singing voice stored in the analyzed data storage section 7. Then, the pitch compensating section 19 corrects the pitch feature data so that the off-pitch amount estimated by the off-pitch amount estimating section 17 is removed from the pitch feature data. When the off-pitch amount is estimated and removed, an audio signal of input singing voice with a low off-pitch level may be obtained. A specific example will be described later.

The pitch transposing section 21 is used when pitch transposition is performed by adding or subtracting an arbitrary value to the pitch feature data. If the pitch transposing section 21 is provided, the voice region of the audio signal of input singing voice may be readily altered or transposition of the audio signal may be readily performed.

The vibrato adjusting section 23 arbitrarily adjusts a vibrato extent in the vibrato segment. The pitch trajectory of the audio signal of input singing voice as shown in FIG. 3B and the dynamics trajectory of the audio signal of input singing voice as shown in FIG. 3C, for example, are smoothed, in order to adjust the vibrato extent. Then, interpolation or extrapolation of the pitch trajectory before smoothing and a smoothed pitch trajectory is performed for the vibrato segment as shown in FIG. 3B. Further, interpolation or extrapolation of the dynamics trajectory before smoothing and a smoothed dynamics trajectory is performed for the vibrato segment as shown in FIG. 3B. The interpolation is performed so that the pitch or dynamics fall between the smoothed trajectory and the trajectory before smoothing. The extrapolation is performed so that the pitch or dynamics fall outside the smoothed trajectory and the trajectory before smoothing.

The smoothing section 25 arbitrarily smoothes pitch feature data and dynamics feature data in segments other than the vibrato segment. The smoothing herein refers to processing equivalent to "arbitrary vibrato extent adjustment" performed outside the vibrato segment. The smoothing has an effect of increasing or reducing a variation in pitch or dynamics in the segments other than the vibrato segment. Then, like the vibrato adjusting section 23, the smoothing section 25 smoothes the pitch trajectory of the audio signal of input singing voice as shown in FIG. 3B and smoothes the dynamics trajectory of the audio signal of input singing voice as shown in FIG. 3C. Then, interpolation or extrapolation of the pitch trajectory before smoothing and a smoothed pitch trajectory is performed for segments other than the vibrato segment as shown in FIG. 3B. Further, interpolation or extrapolation of the dynamics trajectory before smoothing and a smoothed dynamics trajectory is performed for the segments other than the vibrato segment as shown in FIG. 3B.

The algorithm for the computer program shown in FIG. 2 is implemented when lyrics with specified syllable boundaries are used. When lyrics without specified syllable boundaries are used, a step of executing lyric alignment may be inserted after step ST2 in FIG. 2. Further, when the pitch or the singing style is altered, the vibrato segment should be detected before the lyric alignment, and then, a step of using the pitch or singing style alteration function should be inserted.

EXAMPLE

The following will explain, on an item-by-item basis, techniques which are used when the singing synthesis parameter data estimation system of the present invention is specifically implemented. Then, finally, an operation and an evaluation experiment of this embodiment will be described.

[Singing Synthesis Parameter Estimation]

The singing synthesis parameter is estimated according to the following three steps:

analysis of audio signal of input singing voice estimation of pitch and dynamics parameters (repeated) updating of pitch and dynamics parameters First, information necessary for singing synthesis is analyzed and extracted from an audio signal of input singing voice. The analysis is herein performed on not only the audio signal of input singing voice but also a temporary audio signal of singing voice synthesized based on a singing synthesis parameter generated during estimation and lyric data. Analysis of the temporary audio signal of synthesized singing voice is necessary because the audio signal of synthesized singing voice differs according to a difference between singing synthesis conditions (difference in a singing synthesis system or sound source data) even if the singing synthesis parameter is the same. In the following description, the pitch feature and the dynamics feature of the audio signal of input singing voice obtained by analysis will be also referred to monitored values as necessary, in order to clarify distinction between the pitch and dynamics parameters that constitute the singing synthesis parameter.

[Element Technologies of Singing Analysis and Singing Synthesis]

Element technologies about "singing analysis" and "singing synthesis" will be described below. In the following description, it is assumed that the sampling frequency of the audio signal of input singing voice is a monaural audio signal with a sampling frequency of 44.1 kHz, and that a processing time unit is 10 msec.

In the singing synthesis, it is necessary to extract, from the audio signal of input singing voice, parameters comprising the singing synthesis parameter necessary for synthesis of an audio signal of synthesized singing voice. The element technologies for extracting the "pitch", "dynamics", "pronunciation onset time", and "sound duration" of the audio signal of input singing voice will be described below. Each of these element technologies may be of course replaced with a different technology according to the situation.

The pitch (Fo: fundamental frequency) of the audio signal of input singing voice is extracted from the audio signal of input signal voice, and determination as to voiced/non-voiced segments is also made simultaneously. An arbitrary method of estimating the fundamental frequency Fo may be used. In the experiment that will be described later, a method described in "A. Camacho: "SWIPE: A Sawtooth Waveform Inspired Pitch Estimator for Speech And Music", Ph. D. Thesis, University of Florida, 116p., 2007." which is reported to have a low Gross Error was used. Unless specified in particular, the fundamental frequency Fo (fHz) is converted to a real number value (fNote#) of a unit corresponding to the MIDI note number according to the following expression:

$$f_{Note\#} = 12 \times \log_2 \frac{f_{Hz}}{440} + 69 \tag{1}$$

The dynamics of the audio signal of input singing voice is computed as follows, with a window width indicated by N, an audio waveform is indicated by x(t), and a window function indicated by h(t).

$$Pow(t) = \sum_{\tau=t-N/2}^{t+N/2} \left( \sqrt{(x(\tau) \times h(\tau - t))^2} \right) \tag{2}$$

in which the window width N is set to 2048 points (approximately 46 ms), and the window function is set to a Hunning window.

[Pronunciation Onset Time and Sound Duration]

The pronunciation onset time and the sound duration of the audio signal of input singing voice are automatically estimated by Viterbi alignment used in speech recognition. Lyrics including Japanese characters "kanji" and "kana" are converted into a "kana" character sequence by a morphological analyzer (described in Taku Kudo, MeCab: Yet Another Part-of-Speech and Morphological Analyzer; hhtp://mecab-.sourceforge.net/MeCab or the like) that constitutes a part of a lyric alignment section 3, and is then converted to a phoneme sequence. If there is an error in the result of the conversion, the lyric alignment section 3 allows a user to correct manually. In the Viterbi alignment, an alignment grammar that allows a short no-sound state (short pause) to be inserted into a syllable boundary, as shown in FIG. 11B, is used. As an audio model, an HMM model for reading speech [described in Tatsuya Kawahara et al.: Product Software of Continuous Speech Recognition Consortium: 2002 Version, IPSJ SIG Technical Report 2003-SLP-48-1, pp. 1-6, 2003.15] is adapted to the audio signal of input singing voice by the MLLR-MAP method [described in V. V. Digalakis et al.: "Speaker adaptation using combined transformation and Bayesian methods," IEEE Transaction on Speech and Audio Processing, Vol. 4, No. 4, pp. 294-300, 1996. 16].

[Element Technology for Singing Synthesis]

As a singing synthesis section 101, "Hatsune Miku" (hereinafter referred to as CVO1)" and "Kagamine Rin (hereinafter referred to as CVO2)" developed by Crypton Future Media, Inc. were used. These are application products of "Vocaloid 2" (trademark) developed by Yamaha Corporation.

These application products satisfy a requirement that lyrics and musical score information may be received, and parameters about expression (such as pitch and dynamics) may be specified at each time. These application products are commercially available, and with these application products, different sound source data may also be used. Further, by using a VSTi plug-in of "Vocaloid Playback VST Instrument", iteration, which will be described later, may be readily implemented.

[Editing of Audio Signal of Input Singing Voice]

Specific examples of alteration functions implemented by using an off-pitch amount estimating section 17, a pitch compensating section 19, a pitch transposing section 21, a vibrato adjusting section 23, and a smoothing section 25 will be described.

[Pitch Alteration Function]

"Off-pitch correction" and "pitch transposing" functions that alter the pitch of the audio signal of input singing voice are implemented by using the off-pitch estimating section 17 and the pitch compensating section 19 as follows. First, a pitch transition (relative pitch) is compensated for as off-pith correction, because the pitch transition is important for evaluation of a singing skill. Specifically, the pitch is shifted so that the pitch transition is made for each semitone. By adopting such a correction method, an off-pitch may be corrected while maintaining the singing style of the user. For each voiced segment determined to have a voiced sound, an offset Fd defined in the following expression to which the trajectory of the fundamental frequency Fo best fits (is the largest) is determined, while shifting a function i (in a semitone grid for 0 to 127 notes) that assigns a large weight at a semitone interval.

$$F_d = \underset{F}{\operatorname{argmax}} \sum_t \sum_{i=0}^{127} \exp\left\{-\frac{(F_0(t) - F - i)^2}{2\sigma_t^2}\right\} \tag{3}$$

in which σ was set to 0.17, and the fundamental frequency Fo was smoothed by applying a low-pass filter with a cut-off frequency of 5 Hz in advance, in actual implementation. The offset Fd in a range not less than zero and not greater than one was computed, and the pitch was altered according to the following expression:

$$F_0^{(new)}(t) = \begin{cases} F_0(t) - F_d & (0 \le F_d < 0.5) \\ F_0(t) + (1 - F_d) & (0.5 \le F_d < 1) \end{cases} \tag{4}$$

Pitch transposition implemented by the pitch transposing section 21 is the function of wholly or partially shifting the pitch of user's singing voice. With this function, singing in a voice region that cannot be expressed by the user may be synthesized. When performing pitch transposition, a segment desired to be altered is selected, and then, the alteration just by $F_t$ is performed according to the following expression:

$$F_0^{(new)}(t)=F_0(t)+F_t \tag{5}$$

When $F_t$ is set to +12, synthesized singing having a pitch higher than that of singing before alternation by one octave is obtained.

[Singing Style Alteration Function]

The vibrato adjusting section 23 and the smoothing section 25 specifically implement "vibrato extent adjustment" and "pitch and dynamics smoothing" as follows, as singing style alteration functions for the audio signal of input singing voice.

First, a low-pass filter with a cut-off frequency of 3 Hz is applied to a pitch trajectory Fo(t), thereby obtaining a smoothed pitch trajectory $F_{LPF}(t)$ with a dynamic variation component of the fundamental frequency Fo in singing removed therefrom [described in Nonpatent Document 6] is obtained. Similarly, a dynamics trajectory $Pow_{LPF}(t)$ is obtained from a dynamics trajectory Pow(t). Vibrato extend adjustment and pitch and dynamics smoothing adjustment are made according to the following expressions, using a vibrato extent adjustment parameter $r_V$ and a pitch and dynamics smoothing adjustment parameter $r_S$.

$$F_0^{(new)}(t)=r_{\{v|s\}}\times F_0(t)+(1-r_{\{v|s\}})\times F_{LPF}(t) \tag{6}$$

$$Pow^{(new)}(t)=r_{\{v|s\}}\times Pow(t)+(1-r_{\{v|s\}})\times Pow_{LPF}(t) \tag{7}$$

Basically, the vibrato extent adjustment parameter $r_V$ is applied to the vibrato segment detected by a vibrato automatic detection method [described in Tomoyasu Nakano et al.: "An Automatic Singing Skill Evaluation Method for Unknown Melodies," Transactions of Information Processing Society of Japan, Vol. 48, No. 1, pp. 227-236, 2007.] The pitch and dynamics smoothing adjustment parameter $r_S$ is applied to segments other than the vibrato segment. When the vibrato extent adjustment parameter $r_V$ and the pitch and dynamics smoothing adjustment parameter $r_S$ are equal to be one, the audio signal of original input singing voice is obtained. These parameters may be applied to the audio signal of input singing voice, or may be applied to only a segment specified by the user. When the vibrato extent adjustment parameter $r_V$ is set to be larger than one, vibrato may be more emphasized. When the pitch and dynamics smoothing adjustment parameter $r_S$ is set to be smaller than one, the dynamic variation component of the fundamental frequency Fo may be reduced. Overshoot, for example, occurs irrespective of a difference between singing skills. It is found that singing by a professional singer varies less than singing by an amateur singer. Then, by setting the pitch and dynamics smoothing adjustment parameter $r_S$ to be smaller than one, variation of singing may be reduced.

[Singing Synthesis Parameter Estimation]

The singing synthesis parameter is estimated based on an analysis value of the audio signal of input signing voice obtained by singing analysis and an analysis value of the audio signal of synthesized singing voice. Specifically, the singing synthesis parameter is estimated as follows.

[Determination of Initial Values]

First, initial values of lyric alignment, the pitch, and the dynamics are supplied to the system. The start time and the finish time of vowels obtained by Viterbi alignment were supplied to the lyric alignment section 3 as the initial value of lyric alignment. As the pitch parameter, "note pitch (note number)", "pitch bend (PIT)", and "pitch bend sensitivity (PBS)" are used when the above-mentioned "Vocaloid 2" (trademark) is employed as the singing synthesis system. The pitch bend (PIT) herein ranges from −8192 to 8191, the pitch bend sensitivity (PBS) ranges from zero to 24. Default values of the PIT and the PBS are respectively zero and one. When the PBS is set to one, a note number range± one semitone may be represented with a resolution of 16384. The note number ranges from zero to 127. The note number of one corresponds to a semitone, while the note number of 12 corresponds to one octave. On the other hand, "dynamics (DYN)" is used as the dynamics parameter. The dynamics value ranges from zero to 127 (with its default value being 64). The initial values of the PIT, PBS, and DYN as the singing synthesis parameter were all set to the default values at each time.

[Lyric Alignment Estimation and Error Correction]

When lyric alignment that associates lyrics (phoneme sequence) with the audio signal of input singing voice by an audio model is performed, a deviation from the pronunciation onset time or sound duration specified in the singing synthesis system may occur, in addition to a Viterbi alignment error. Accordingly, in the lyric alignment where a result of the Viterbi alignment is used without alteration, a deviation will occur between voiced segments (segments determined to have voiced sounds by signal processing) of the audio signal of input singing voice and the audio signal of synthesized singing voice. Then, the deviation of voiced segments is amended by the following two processes.

When two syllables of synthesized singing voice are not connected and when a segment including the two syllables is determined as the voiced segment of the audio signal of input singing voice, the end of the preceding one of the two syllables is extended to coincide with the beginning of the following one of the two syllables.

The start time and the finish time of a syllable in the voiced segment of the audio signal of synthesized singing voice are contracted or extended so that the voiced segment of the audio signal of synthesized singing voice deviated from the voiced segment of the audio signal of input singing voice coincides with the voiced segment of the audio signal of input singing voice.

These processes and singing synthesis (including note number estimation as well) are repeatedly performed, thereby causing the voiced segment of the audio signal of synthesized singing voice to coincide with the voiced segment of the audio signal of input singing voice.

In the embodiment described above, when the user listens to synthesized singing obtained by reproduction of the audio signal of synthesized singing voice, notices an error in a certain syllable boundary, and points out the error, a candidate for another syllable boundary is presented. The candidate is obtained as follows. Top three boundaries having large MFCC variations (temporal variations) in terms of the magnitude of the MFCC variations are extracted, and the pitch of each of the boundaries is synthesized through combination by iteration. Then, an audio signal of synthesized singing voice thus obtained having a minimum amplitude spectral distance with respect to the audio signal of input singing voice is presented to the user. When the user points out the presented boundary candidate is not correct, the next candidate is presented. The presented candidate may be finally modified manually. An MFCC variation Mf(t) is defined by the following expression, using ΔMFCC(t, i) of an order I.

$$Mf(t) = \sum_{i=1}^{I} \sqrt{\Delta MFCC(t, i)^2} \tag{8}$$

in which MFCCs are calculated from the audio signal of input singing voice resampled at 16 kHz, and the order I is set to 12. The amplitude spectral distance is obtained by calculating amplitude spectra of the audio signals of input singing voice and synthesized singing voice using a Hunning window (with a window width of 2048 points). The amplitude spectra of the audio signals of input singing voice and synthesized singing voice are respectively indicated by $S_{orf}(t, f)$ and $S_{syn}(t, f)$. Then, the spectral distance is defined by the following expression:

$$err_{env}^2 = \sum_t \sum_{f=50\,Hz}^{3000\,Hz} (\overline{S_{org}(t, f)} - \overline{S_{syn}(t, f)})^2 \tag{9}$$

$$\overline{S_{\{org|syn\}}(t, f)} = \frac{S_{\{org|syn\}}(t, f)}{\sum_f S_{\{org|syn\}}(t, f)} \tag{10}$$

Herein, the bandwidth of the frequency f is limited from 50 Hz to 3000 Hz so that components of the frequency f sufficiently include first and second formant where a vowel feature is obtained. A time t corresponds to a segment including two syllables before the target syllable boundary and two syllables after the target syllable boundary. Finally, the user manually corrects only the boundary error that cannot be corrected by the above-mentioned processes.

[Note Number Determination]

Note numbers are determined from the monitored fundamental frequency Fo. Depending on a combination of the PIT and the PBS, the audio signal of synthesized singing voice can be indicated by the note numbers±two octaves. However, when the PBS is large, a quantization error is increased. Then, a note number (Note#) is selected according to the following expression so as to reduce the value of the PBS, based on the occurrence frequency of a pitch that is present in the segment of the note (as shown in FIG. 4).

$$\text{Note\#} = \underset{n}{\operatorname{argmax}}\left(\sum_t \exp\left\{-\frac{(n - F_0(t))^2}{2\sigma^2}\right\}\right) \tag{11}$$

in which σ is set to 0.33, and t is set to the duration of the note. With this arrangement, the note number where the fundamental frequency Fo remains for a long time is selected.

[Determination of Pitch Bend]

A pitch parameter (comprising the PIT and the PBS) is updated by iteration and is then estimated, with the note number fixed, so that a pitch $Fo^{(n)}_{syn}(t)$ of the audio signal of synthesized singing voice gets close to a pitch $Fo_{org}(t)$ of the audio signal of input singing voice. When a value at the time t at an nth iteration, obtained by converting the PIT and the PBS to the value corresponding to the note number, is indicated by $Pb^{(n)}(t)$, an updating expression is as follows:

$$Pb^{(n+1)}(t) = Pb^{(n)}(t) + (F0_{org}(t) - F0^{(n)}_{syn}(t)) \tag{12}$$

| | |
|---|---|
| THE PITCH OF THE AUDIO SIGNAL OF INPUT SINGING VOICE | $F0_{org}(t)$ |
| THE PITCH AFTER SYNTHESIS | $F0^{(n)}_{syn}(t)$ |

in which $Fo_{org}(t)$ indicates the pitch of the audio signal of input singing voice, while $Fo^{(n)}_{syn}(t)$ indicates the pitch after synthesis.

Based on the updated value $Pb^{(n+1)}(t)$ thus obtained, values of the PIT and the PBS are determined so that the PBS value is reduced.

[Estimation of Dynamics Parameter]

The absolute value of the dynamics feature of the audio signal of input singing voice varies due to a difference in recording conditions. Thus, the dynamics feature is converted to a relative value. The dynamics of the audio signal of input singing voice is multiplied by a normalization factor α in order to estimate the parameter indicating a relative variation of the dynamics. In order to completely represent the relative variation of the audio signal of input singing voice, it is necessary to adjust the dynamics of the audio signal of input singing voice at each time to be not more than the dynamics of a singing voice synthesized with "the dynamics DYN" set to 127. However, when such a requirement is to be satisfied at a point A in FIG. 8, for example, the target dynamics gets too small, and the quantization error is increased. Then, instead of reproducing a part of the singing voice such as the point A in FIG. 8, conversion to the relative value is performed to obtain a high reproduction level as a whole. Then, with a monitored dynamics value of the audio signal of input singing voice indicated by $Pow_{org}(t)$ and a monitored dynamics value of synthesized singing voice when "the dynamics DYN" assumes 64 indicated by $Pow^{DYN}=64_{syn}(t)$ the normalization factor $\alpha$ that minimizes the following expression is determined:

$$err^2 = \sum_t (\alpha Pow_{org}(t) - Pow_{syn}^{DYN=64}(t))^2 \tag{13}$$

THE DYNAMIC AFTER SYNTHESIS $Pow_{syn}^{DYN=64}(t)$

THE DYNAMICS OF THE AUDIO SIGNAL OF INPUT SINGING $Pow_{org}(t)$ in which $Pow^{DYN}=64_{syn}(t)$ indicates the synthesized dynamics and $Pow_{org}(t)$ indicates the dynamics of the audio signal of input singing voice.

The dynamics parameter ("DYN") is iteratively estimated, with the thus-obtained normaliazation factor $\alpha$ fixed. For doing so, first, monitored values of the dynamics of synthesized singings for all "dynamics DYN" are obtained. A phrase is actually synthesized for each of "the dynamics DYN"=(0, 32, 64, 96, 127) and its monitored dynamics value is obtained. The other dynamics values are obtained by linear interpolation. When the monitored dynamics value obtained from conversion of "the dynamics DYN" at an nth iteration is indicated by $Dyn^{(n)}(t)$, and the monitored dynamics value of singing synthesized for "the dynamics DYN" is indicated by $Pow^{(n)}_{syn}(t)$, the following updating expression is obtained:

$$Dyn^{(n+1)}(t)=Dyn^{(n)}(t)+(\alpha Pow_{org}(t)-Pow_{syn}^{(n)}(t)) \tag{14}$$

"The dynamics $Dyn^{(n+1)}(t)$" thus obtained is converted to the dynamics parameter "DYN" using relationships between all "the dynamics DYN" and their monitored dynamics values.

[Operation and Evaluation Experiment]

An actual operation result of a specific example of the present invention will be described. Then, a result of evaluation of the example of the present invention in terms of "effectiveness of the lyric alignment error correcting function", "necessity of the iteration", and "robustness to a difference in sound source data" will be described.

Figure 15:
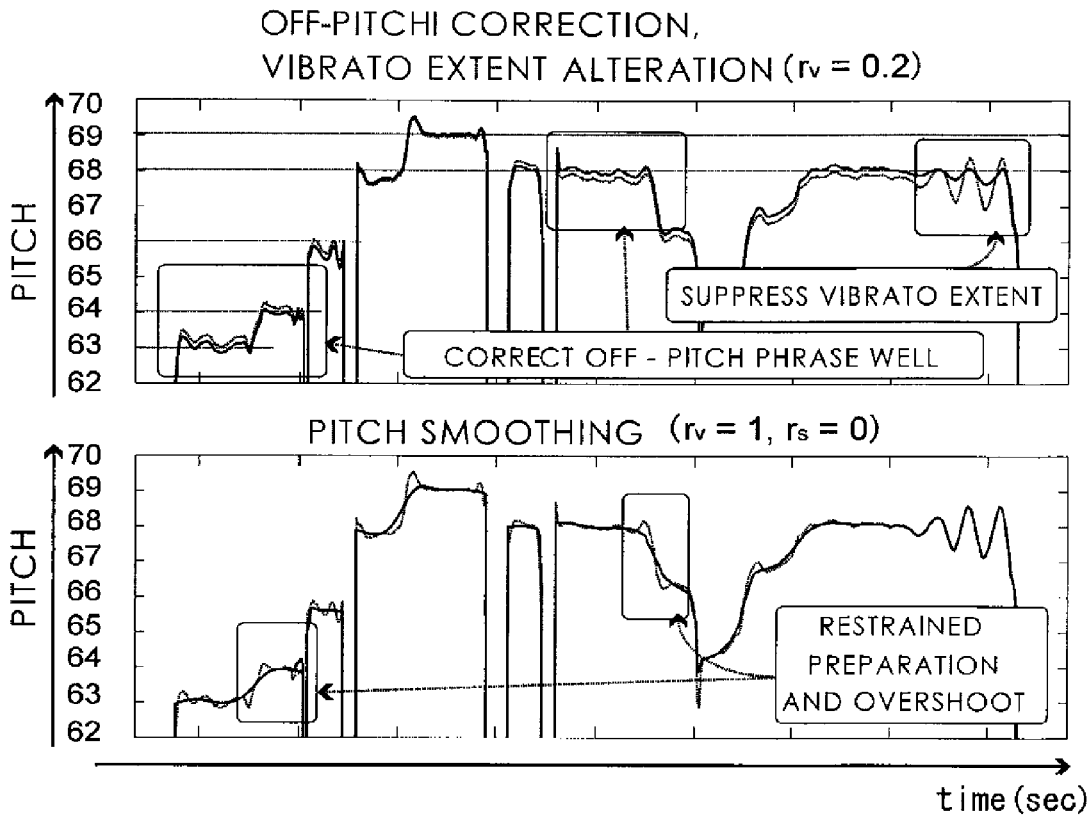
FIG. 15 comprises graphs showing operation results of a pitch alteration function and a singing style alteration function.

FIG. 15 shows results where "off-pitch correction" has been applied as the pitch alteration function and "vibrato extent alteration" and "pitch smoothing" have been applied as the singing style alteration function. Referring to FIG. 15, solid lines indicate pitch and dynamics features after the alteration and broken lines indicate pitch and dynamics features before the alteration. It can be seen from FIG. 15 that pitch correction is possible, only a vibrato extent can be altered, and a variation such as preparation can be reduced by smoothing.

[Experimental Conditions For Evaluation]

The technologies described above were used as the element technologies about singing analysis and singing synthesis. Then, in the singing synthesis section ("Vocaloid 2"), experiments were carried out using the default values, except that no vibrato is provided and a pitch bend depth is set to 0%. As sound source data, the CV01 and CV02 described above were used. In the experiments, singing data without accompaniment selected from among the "RWC Music Database (Popular Music) RWC-MDB-P-2001 disclosed in [Masataka Goto et al.: "RWC Music Database: Database of Copyright-cleared Music pieces and Instrument Sounds for Research Purposes,", Transactions of Information Processing Society of Japan, Vol. 45, No. 3, pp. 728-738, 2004.] was used as an audio signal of input singing voice instead of user's singing.

The following two A and B types of experiments were carried out. Music pieces used in each experiment are shown in Table 1.

TABLE 1

Target Singing and Singing Synthesis Sound Source Data Used in Experiments

| Experiment No. | Piece No. | Piece Used Portion | Length | Target Singing (Singer Name) | Synthesis Sound Souce Data |
|---|---|---|---|---|---|
| A | No. 07 | No. 1 Portion | 103 sec | Tomomi Ogata | CV01 |
| A | No. 16 | No. 1 Portion | 100 sec | Hiromi Yoshii | CV02 |
| B | No. 07 | Beginning Portion | 2.4 sec | Tomomi Ogata | CV01, 02 |
| B | No. 16 | Beginning Portion | 3.5 sec | Hiromi Yoshii | CV01, 02 |
| B | No. 54 | Beginning Portion | 2.7 sec | Rin | CV01, 02 |
| B | No. 55 | Beginning Portion | 2.9 sec | Akiko Kaburaki | CV01, 02 |

※Piece number is obtained from the RWC-MDB-P-2001 database.

Type A Experiment: A long singing portion (No. 1 portion) of the music piece is used to evaluate effectiveness of the lyric alignment error correcting function Type B Experiment: A short singing portion (phrase) of the music piece is used to evaluate necessity and robustness of the iteration in parameter estimation, using an error ($err^{(n)}_{\{Fo|pow\}}$) and a relative error rate ($\Delta err^{(n)}_{\{Fo|pow\}}$) which will be defined by the following expressions:

$$err_{f0}^{(n)} = \sum_t (F0_{org}(t) - F0_{syn}^{(n)})^2 \tag{15}$$

$$err_{pow}^{(n)} = \sum_t (Pow_{org}(t) - Pow_{syn}^{(n)}(t))^2 \tag{16}$$

$$\Delta err_{\{f0|pow\}}^{(n)} = \frac{err_{\{f0|pow\}}^{(n)}}{err_{\{f0|pow\}}^{(n=0)}} \times 100 \tag{17}$$

THE ERROR $(err_{\{f0|pow\}}^{(n)})$

THE *RRLATIVE* RATE $(\Delta err_{\{f0|pow\}}^{(n)})$ where ($err^{(n)}_{\{Fo|pow\}}$) indicates the error, and ($\Delta err^{(n)}_{\{Fo|pow\}}$) indicates the relative error rate.

Since Type B Experiment was carried out to make evaluation on updating of the parameters, lyric alignment (about the pronunciation onset time and sound duration) was manually performed.

Type A Experiment: Lyric Alignment Error Correction

As results of the Viterbi alignment, a significant error such as the one extending over phrases did not occur in the piece of No. 07 in Table 1. Two significant errors occurred in the piece of No. 16 in Table 1. These errors were manually corrected, and then the Type A Experiment was carried out on each of these pieces. Table 2 shows the results of the experiments.

TABLE 2

Number of Indicated Syllable Boundary Errors and Number of Times of Indication of the Errors (Type A Experiment)

| Piece Number | Synthesis Sound Source Data | Total Number of Syllables | Number of Errors at nth Time of Indication of Error(s) 0 (Initial Value) | 1 | 2 | 3 |
|---|---|---|---|---|---|---|
| No. 07 | CV01 | 166 | 8 | 3 | 1 | 0 |
| No. 16 | CV02 | 128 | 1 | 0 | — | — |

In the music piece of No. 07 in Table 2, there were eight syllable boundary errors among a total of 166 syllables. It can be seen that these errors could be corrected at the third time of indication. The syllable boundary errors in automatic estimation often occurred in portions having syllables immediately after syllable boundaries, which started with /w/ and /r/ (semi-vowels and liquid sounds), and /m/ and /n/ (nasal sounds).

It can be seen from the results in Table 2 that the number of syllable boundary errors is small, and that the syllable errors may be improved at two or three times of indication of the errors. In the result example of the music piece of No. 07, correct syllable boundaries were obtained for 166 syllables by indication of 12 errors in total. It is clear from this result that the present invention may help a user reduce burden.

Type B Experiment: Synthesis Parameter Estimation From User's Singing

Figure 16:
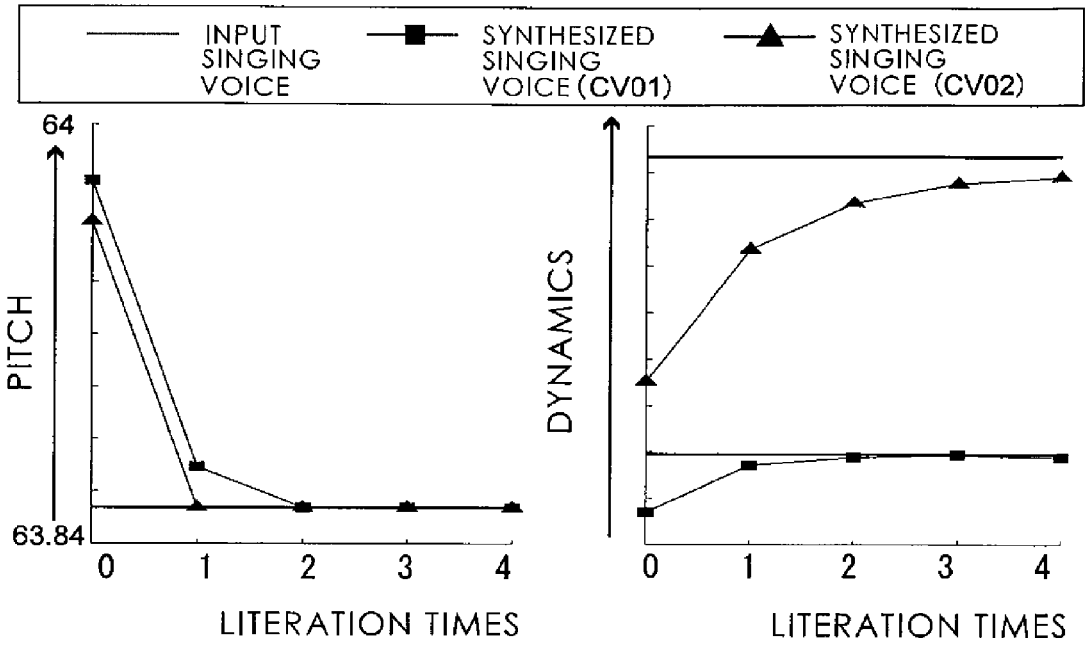
FIG. 16 comprises graphs showing pitch and dynamics transitions caused by iterations (in an experiment of type B).

The number of errors in each of the music pieces targeted for the Type B Experiment was reduced by the iteration. The relative pitch error rate and the relative dynamics error rate of each music piece with respect to the initial values after four iterations were 1.7 to 2.8% and 13.8 to 17.5%, respectively. Table 3 shows the relative pitch and dynamics error rates of the music piece of No. 07. FIG. 16 shows experiment results on the music piece of No. 07. FIG. 16 comprises graphs showing pitch and dynamics transitions caused by the iteration, obtained from the Type B Experiment. Each graph shows a 0.84-sec portion of the music piece of No. 07 on which pitch parameter estimation and dynamics parameter estimation were performed. In FIG. 16, the normalization factor $\alpha$ for obtaining a target dynamics value was different between the synthesis sound data CV01 and CV02.

TABLE 3

Relative Error Rate [%] at nth Internation (Type B Experiment: No. 07)

| Estimated Parameter | Singer Data | Relative Error Rate at nth Iteration First Time | Second Time | Third Time | Fourth Time |
|---|---|---|---|---|---|
| Pitch | CV01 | 13.8 | 4.7 | 2.1 | **2.4** |
| Pitch | CV02 | 8.1 | 3.7 | 2.3 | 1.7 |
| Dynamics | CV01 | 19.8 | 17.9 | 17.6 | 17.5 |
| Dynamics | CV02 | 16.0 | 14.2 | 13.9 | 13.8 |

A figure in bold indicates an increase in the number of the errors.

It can be seen from FIG. 16 and Table 3 that the number of the errors is reduced by the iteration. It means that the audio signal obtained by singing synthesis gets close to the audio signal of input singing voice. Even if the initial values were different due to a difference between the sound source data, the parameters for obtaining the pitch and dynamics of the audio signal of input singing voice could be finally estimated. At the fourth iteration using the sound source data CV01 in pitch parameter estimation, the increase in the number of the errors occurred (as shown in Table 3). The increase in the number of the errors is considered to be caused by the quantization error of the pitch parameter. Such an error is present in the dynamics parameter as well, and the number of the errors may be slightly increased according to the situation. In this case, the synthesis parameters often have been obtained with a high accuracy. Thus, quality of synthesized singing is not greatly affected by the slight increase in the error.

A description about the above embodiment was made assuming that user's singing is supplied as the audio signal of input singing voice. An output of the singing synthesis section may be supplied instead of the user's singing. Assume that synthesized singing obtained by manual parameter adjustment for the sound source data CV01 is used as the audio signal of input singing voice, and parameter estimation for the sound source data CV02 is performed by the system of the present invention, for example. Then, the sound source data (timbre) may be switched without performing manual adjustment again.

While the preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A singing synthesis parameter data estimation system that estimates singing synthesis parameter data used in a singing synthesis system, the singing synthesis system comprising:

a singing sound source database storing one or more singing sound source data;

a singing synthesis parameter data storing section that stores singing synthesis parameter data which represents an audio signal of singing voice by a plurality of parameters including at least both of a pitch parameter and a dynamics parameter;

a lyric data storing section that stores lyric data having specified syllable boundaries corresponding to an audio signal of input singing voice; and a singing synthesis section that synthesizes and outputs an audio signal of synthesized singing voice suited to the singing sound source data selected from the singing sound source database, based on the singing sound source data, the singing synthesis parameter data, and the lyric data;

the singing synthesis parameter data estimation system comprising:

an input singing voice audio signal analysis section that analyzes a plurality of features of the audio signal of input singing voice, the features including at least both of a pitch feature and a dynamics feature;

a pitch parameter estimating section that estimates the pitch parameter, by which a pitch feature of the audio signal of synthesized singing voice is got close to the pitch feature of the audio signal of input singing voice, based on at least both of the pitch feature and the lyric data of the audio signal of input singing voice, with the dynamics parameter kept constant;

a dynamics parameter estimating section that, after the pitch parameter estimating section has completed estimation of the pitch parameter, converts the dynamics feature of the audio signal of input singing voice to a relative value with respect to a dynamics feature of the audio signal of synthesized singing voice and estimates the dynamics parameter, by which the dynamics feature of the audio signal of synthesized singing voice is got close to the dynamics feature of the audio signal of input singing voice that has been converted to the relative value;

a singing synthesis parameter data estimating section that estimates the singing synthesis parameter data, based on the pitch parameter estimated by the pitch parameter estimating section and the dynamics parameter estimated by the dynamics parameter estimating section to store the singing synthesis parameter data in the singing synthesis parameter data storing section; and a lyric alignment section that generates the lyric data having the specified syllable boundaries, based on lyric data without specified syllable boundaries and the audio signal of input singing voice;

the pitch parameter estimating section repeating estimation of the pitch parameter predetermined times until the pitch feature of a temporary audio signal of synthesized singing voice reaches a pitch feature close to the pitch feature of the audio signal of input singing voice, or repeating estimation of the pitch parameter until the pitch feature of the temporary audio signal of synthesized singing voice converges to the pitch feature of the audio signal of input singing voice, the temporary audio signal of synthesized singing voice being obtained by synthesis of temporary singing synthesis parameter data estimated based on the estimated pitch parameter, by the singing synthesis section;

the dynamics parameter estimating section repeating estimation of the dynamics parameter predetermined times until the dynamics feature of a temporary audio signal of synthesized singing voice reaches a dynamics feature close to the dynamics feature of the audio signal of input singing voice that has been converted to the relative value, or repeating estimation of the dynamics parameter until the dynamics feature of the temporary audio signal of synthesized singing voice converges to the dynamics feature of the audio signal representing the input singing voice that has been converted to the relative value, the temporary audio signal of synthesized singing voice being obtained by synthesis of temporary singing synthesis parameter data by the singing synthesis section, the temporary singing synthesis parameter data being generated based on the pitch parameter completely estimated by the pitch parameter estimating section and the estimated dynamics parameter;

the input singing voice audio signal analysis section including:

a function of estimating a fundamental frequency Fo from the audio signal of input singing voice in a predetermined cycle, monitoring the pitch of the audio signal of input singing voice based on the fundamental frequency, and then storing the monitored pitch in an analyzed data storing section as pitch feature data;

a function of estimating a voiced sound property from the audio signal of input singing voice, monitoring a segment in which the voiced sound property is higher than a predetermined threshold value as a voiced segment of the audio signal of input singing voice, and storing the voiced segment in the analyzed data storing section;

a function of monitoring the dynamics feature of the audio signal of input singing voice and then storing the monitored dynamics feature in the analyzed data storing section as dynamics feature data; and a function of monitoring a segment where a vibrato is present from the pitch feature data and then storing the segment with the vibrato in the analyzed data storing section as a vibrato segment;

the singing synthesis parameter data estimation system further comprising:

an off-pitch amount estimating section that estimates an off-pitch amount from the pitch feature data in voiced segments of the audio signal of the input singing voice, stored in the analyzed data storing section;

a pitch compensating section that compensates for the pitch feature data so that the off-pitch amount estimated by the off-pitch estimating section is removed from the pitch feature data;

a pitch transposing section that adds an arbitrary value to the pitch feature data, thereby performing pitch transposition;

a vibrato adjusting section that arbitrarily adjusts a vibrato extent in the vibrato segment; and a smoothing section that arbitrarily smoothes the pitch feature data and the dynamics feature data in segments other than the vibrato segment.

2. The singing synthesis parameter data estimation system according to claim 1, wherein the pitch parameter comprises a parameter element representing a reference pitch level for each of signals in a plurality of partial segments of the audio signal of input singing voice, the partial segments respectively corresponding to a plurality of syllables of the lyric data; a parameter element indicating a temporal relative pitch variation of each of the signals in the partial segments with respect to the reference pitch level; and a parameter element indicating a variation width of each of the signals in the partial segments in a pitch direction; and the pitch parameter estimating section sets a predetermined initial value of the parameter element indicating the temporal relative pitch variation and a predetermined initial value of the parameter element indicating the variation width in the pitch direction after determining the parameter element indicating the reference pitch level; generates the temporary singing synthesis parameter data based on the initial values; estimates the parameter element indicating the temporal relative pitch variation and the parameter element indicating the variation width in the pitch direction so that the pitch feature of the temporary audio signal of synthesized singing voice obtained by synthesis of the temporary singing synthesis parameter data by the singing synthesis section reaches a pitch feature close to the pitch feature of the audio signal of input singing voice; generates next temporary singing synthesis parameter data based on the estimated parameter elements, and repeats estimation of the parameter elements indicating the temporal relative pitch variation and the variation width in the pitch direction so that a pitch feature of a temporary audio signal of synthesized singing voice obtained by synthesis of the next temporary singing synthesis parameter data by the singing synthesis section reaches a pitch feature close to the pitch feature of the audio signal of input singing voice.

3. The singing synthesis parameter data estimation system according to claim 2, wherein the parameter element indicating the reference pitch level is a note number compliant with the MIDI standard or a note number of a commercially available singing synthesis system;

the parameter element indicating the temporal relative pitch variation with respect to the reference pitch level is a pitch bend (PIT) in compliant with the MIDI standard or a pitch bend (PIT) of the commercially available singing synthesis system; and the parameter element indicating the variation width in the pitch direction is a pitch bend sensitivity (PBS) compliant with the MIDI standard or a pitch bend sensitivity (PBS) of the commercially available singing synthesis system.

4. The singing synthesis parameter data estimation system according to claim 1, wherein the dynamics parameter estimating section includes:

a function of determining a normalization factor $\alpha$ so that a distance between a dynamics feature of a temporary audio signal of synthesized singing voice and the dynamics feature of the audio signal of input singing voice is the smallest, the temporary audio signal of synthesized singing voice being obtained by synthesis of temporary singing synthesis parameter data by the singing synthesis section, the temporary singing synthesis parameter data being generated based on the completely estimated pitch parameter and the dynamics parameter set to the central value of a settable dynamics parameter range; and a function of multiplying the dynamics feature of the audio signal of input singing voice by the normalization factor $\alpha$, thereby estimating the dynamics feature converted to the relative value.

5. The singing synthesis parameter data estimation system according to claim 4, wherein the dynamics parameter is an expression compliant with the MIDI standard or dynamics (DYN) of a commercially available singing synthesis system.

6. The singing synthesis parameter data estimation system according to claim 1, wherein the lyric alignment section comprises:

a phoneme sequence converting section that converts lyrics included in the lyric data into a phoneme sequence composed of a plurality of phonemes;

a phoneme manual modifying section that allows manual modification of a result of the conversion by the phoneme sequence converting section;

an alignment estimating section that estimates a start time and a finish time of each of the phonemes included in the phoneme sequence in the audio signal of input singing voice after estimating an alignment grammar;

an alignment and manual modifying section that allows manual modification of the start time and the finish time of each of the phonemes included in the phoneme sequence estimated by the alignment estimating section;

a phoneme-to-syllable sequence converting section that converts the phoneme sequence into a sequence of syllables;

a voiced segment amending section that amends a deviation of the voiced segment in the syllable sequence output from the phoneme-to-syllable sequence converting section;

a syllable boundary correcting section that allows correction of an error in a syllable boundary in the syllable sequence where the deviation of the voiced segment has been amended, when a user manually points out the syllable boundary error; and a lyric data storing section that stores the syllable sequence as the lyric data having the specified syllable boundaries.

7. The singing synthesis parameter data estimation system according to claim 6, wherein the voiced segment amending section comprises:

a partial syllable sequence generating section that connects a plurality of the syllables included in one of the voiced segments resulting from analysis by the input singing voice audio signal analysis section, thereby generating a partially connected syllable sequence; and an expansion and contraction modifying section that extends or contracts the syllable by changing the start time and the finish time of each of the syllables included in the partially connected syllable sequence so that a voiced segment resulting from analysis of the temporary audio signal of synthesized singing voice obtained by synthesis by the singing synthesis section coincides with the voiced segment resulting from the analysis by the input singing voice audio signal analysis section.

8. The singing synthesis parameter data estimation system according to claim 6, wherein the syllable boundary correcting section comprises:

a calculating section that calculates a temporal variation in a spectrum of the audio signal of input singing voice; and a correction executing section that sets a segment comprising N1 (N1 being a positive integer of one or more) syllables before a point of the syllable boundary error and N1 syllables after the point of the syllable boundary error to a candidate calculation target segment, and sets a segment comprising N2 (N2 being a positive integer of one or more) syllables before the point of the syllable boundary error and N2 syllables after the point of the syllable boundary error to a distance calculation segment, determines N3 (N3 being a positive integer of one or more) points with large temporal variations in the spectrum as boundary candidate points based on a temporal variation in the spectrum in the candidate calculation target segment, obtains distances of hypotheses where the syllable boundary is shifted to the respective boundary candidate points, presents one of the hypotheses having the minimum distance to the user, moves down the boundary candidate point to present another hypothesis until the user determines the presented another hypothesis to be correct, and executes the correction by shifting the syllable boundary to the boundary candidate point for the presented another hypothesis when the user determines the presented another hypothesis to be correct.

9. The singing synthesis parameter data estimation system according to claim 8, wherein the correcting executing section, in order to obtain the distance of hypothesis where the syllable boundary is shifted to the boundary candidate point, estimates the pitch parameter for the distance calculation segment, obtains an audio signal of synthesized singing voice obtained by synthesis of the singing synthesis parameter data estimated based on the estimated pitch parameter, and calculates a spectral distance between the audio signal of input singing voice and the audio signal of synthesized singing voice for the distance calculation segment as the distance of hypothesis.

10. The singing synthesis parameter data estimation system according to claim 8, wherein the temporal variation in the spectrum is represented by a delta Mel-Frequency Cepstrum Coefficient (ΔMFCC).

11. The singing synthesis parameter data estimation system according to claim 9, wherein the temporal variation in the spectrum is represented by a delta Mel-Frequency Cepstrum Coefficient (ΔMFCC).

12. A singing synthesis parameter data estimation system that estimates singing synthesis parameter data used in a singing synthesis system, the singing synthesis system comprising:

a singing sound source database storing one or more singing sound source data;

a singing synthesis parameter data storing section that stores singing synthesis parameter data which represents an audio signal of singing voice by a plurality of parameters including at least both of a pitch parameter and a dynamics parameter;

a lyric data storing section that stores lyric data having specified syllable boundaries corresponding to an audio signal of input singing voice; and a singing synthesis section that synthesizes and outputs an audio signal of synthesized singing voice suited to the singing sound source data selected from the singing sound source database, based on the singing sound source data, the singing synthesis parameter data, and the lyric data;

the singing synthesis parameter data estimation system comprising:

an input singing voice audio signal analysis section that analyzes a plurality of features of the audio signal of input singing voice, the features including at least both of a pitch feature and a dynamics feature;

a pitch parameter estimating section that estimates the pitch parameter, by which a pitch feature of the audio signal of synthesized singing voice is got close to the pitch feature of the audio signal of input singing voice, based on at least both of the pitch feature and the lyric data of the audio signal of input singing voice, with the dynamics parameter kept constant;

a dynamics parameter estimating section that, after the pitch parameter estimating section has completed estimation of the pitch parameter, converts the dynamics feature of the audio signal of input singing voice to a relative value with respect to a dynamics feature of the audio signal of synthesized singing voice, and estimates the dynamics parameter, by which the dynamics feature of the audio signal of synthesized singing voice is got close to the dynamics feature of the audio signal of input singing voice that has been converted to the relative value; and a singing synthesis parameter data estimating section that estimates the singing synthesis parameter data, based on the pitch parameter estimated by the pitch parameter estimating section and the dynamics parameter estimated by the dynamics parameter estimating section to store the singing synthesis parameter data in the singing synthesis parameter data storing section;

the pitch parameter estimating section repeating estimation of the pitch parameter predetermined times until the pitch feature of a temporary audio signal of synthesized singing voice reaches a pitch feature close to the pitch feature of the audio signal of input singing voice, or repeating estimation of the pitch parameter until the pitch feature of the temporary audio signal of synthesized singing voice converges to the pitch feature of the audio signal of input singing voice, the temporary audio signal of synthesized singing voice being obtained by synthesis of temporary singing synthesis parameter data estimated based on the estimated pitch parameter, by the singing synthesis section;

the dynamics parameter estimating section repeating estimation of the dynamics parameter predetermined times until the dynamics feature of a temporary audio signal of synthesized singing voice reaches a dynamics feature close to the dynamics feature of the audio signal of input singing voice that has been converted to the relative value, or repeating estimation of the dynamics parameter until the dynamics feature of the temporary audio signal of synthesized singing voice converges to the dynamics feature of the audio signal of input singing voice that has been converted to the relative value, the temporary audio signal of synthesized singing voice being obtained by synthesis of temporary singing synthesis parameter data by the singing synthesis section, the temporary singing synthesis parameter data being generated based on the pitch parameter completely estimated by the pitch parameter estimating section and the estimated dynamics parameter.

13. The singing synthesis parameter data estimation system according to claim 12, further comprising:

a lyric alignment section that generates the lyric data having the specified syllable boundaries, based on lyric data without specified syllable boundaries and the audio signal of the input singing voice.

14. The singing synthesis parameter estimation system according to claim 12, wherein the input singing voice audio signal analysis section includes:

a function of estimating a fundamental frequency Fo from the audio signal of input singing voice in a predetermined cycle, monitoring the pitch of the audio signal of input singing voice based on the fundamental frequency, and then storing the monitored pitch in an analyzed data storing section as pitch feature data;

a function of estimating a voiced sound property from the audio signal of input singing voice, monitoring a segment in which the voiced sound property is higher than a predetermined threshold value as a voiced segment of the audio signal of input singing voice, and storing the voiced segment in the analyzed data storing section; and a function of monitoring the dynamics feature of the audio signal of input singing voice and then storing the monitored dynamics feature in the analyzed data storing section as dynamics feature data.

15. The singing synthesis parameter data estimation system according to claim 14, further comprising:

an off-pitch amount estimating section that estimates an off-pitch amount from the pitch feature data in the voiced segments of the audio signal of input singing voice stored in the analyzed data storing section; and a pitch compensating section that compensates for the pitch feature data so that the off-pitch amount estimated by the off-pitch estimating section is removed from the pitch feature data.

16. The singing synthesis parameter data estimation system according to claim 14, further comprising:

a pitch transposing section that adds an arbitrary value to the pitch feature data, thereby performing pitch transposition.

17. The singing synthesis parameter data estimation system according to claim 14, wherein the input voice audio signal analysis section further includes a function of monitoring from the pitch feature data a segment where a vibrato is present and then storing the segment with the vibrato in the analyzed data storing section as a vibrato segment; and the singing synthesis parameter data estimation system further comprises:

a vibrato adjusting section that arbitrarily adjusts a vibrato extent in the vibrato segment.

18. The singing synthesis parameter data estimation system according to claim 14, wherein the input singing voice audio signal analysis section further includes the function of monitoring from the pitch feature data the segment where the vibrato is present and then storing the segment with the vibrato in the analyzed data storing section as the vibrato segment; and the singing synthesis parameter data estimation system further comprises:

a smoothing section that arbitrarily smoothes the pitch feature data and the dynamics feature data in segments other than the vibrato segment.

19. The singing synthesis parameter data estimation system according to claim 12, wherein the pitch parameter comprises a parameter element representing a reference pitch level for each of signals in a plurality of partial segments of the audio signal of input singing voice, the partial segments respectively corresponding to a plurality of syllables of the lyric data; a parameter element indicating a temporal relative pitch variation of each of the signals in the partial segments with respect to the reference pitch level; and a parameter element indicating a variation width of each of the signals in the partial segments in a pitch direction; and the pitch parameter estimating section sets a predetermined initial value of the parameter element indicating the temporal relative pitch variation and a predetermined initial value of the parameter element indicating the variation width in the pitch direction after determining the parameter element indicating the reference pitch level; generates the temporary singing synthesis parameter data based on the initial values; estimates the parameter element indicating the temporal relative pitch variation and the parameter element indicating the variation width in the pitch direction so that the pitch feature of the temporary audio signal of synthesized singing voice obtained by synthesis of the temporary singing synthesis parameter data by the singing synthesis section reaches a pitch feature close to the pitch feature of the audio signal of input singing voice; generates next temporary singing synthesis parameter data based on the estimated parameter elements, and repeats estimation of the parameter elements indicating the temporal relative pitch variation and the variation width in the pitch direction so that a pitch feature of a temporary audio signal of synthesized singing voice obtained by synthesis of the next temporary singing synthesis parameter data by the singing synthesis section reaches a pitch feature close to the pitch feature of the audio signal of input singing voice.

20. The singing synthesis parameter data estimation system according to claim 19, wherein the parameter element indicating the reference pitch level is a note number compliant with the MIDI standard or a note number of a commercially available singing synthesis system;

the parameter element indicating the temporal relative pitch variation with respect to the reference pitch level is a pitch bend (PIT) in compliant with the MIDI standard or a pitch bend (PIT) of the commercially available singing synthesis system; and the parameter element indicating the variation width in the pitch direction is a pitch bend sensitivity (PBS) compliant with the MIDI standard or a pitch bend sensitivity (PBS) of the commercially available singing synthesis system.

21. The singing synthesis parameter data estimation system according to claim 12, wherein the dynamics parameter estimating section includes:

a function of determining a normalization factor $\alpha$ so that a distance between a dynamics feature of a temporary audio signal of synthesized singing voice and the dynamics feature of the audio signal of input singing voice is the smallest, the temporary audio signal of synthesized singing voice being obtained by synthesis of temporary singing synthesis parameter data by the singing synthesis section, the temporary singing synthesis parameter data being generated based on the completely estimated pitch parameter and the dynamics parameter set to the central value of a settable dynamics parameter range; and a function of multiplying the dynamics feature of the audio signal of input singing voice by the normalization factor $\alpha$, thereby estimating the dynamics feature converted to the relative value.

22. The singing synthesis parameter data estimation system according to claim 21, wherein the dynamics parameter is an expression compliant with the MIDI standard or dynamics (DYN) of a commercially available singing synthesis system.

23. The singing synthesis parameter data estimation system according to claim 13, wherein the lyric alignment section comprises:

a phoneme sequence converting section that converts lyrics included in the lyric data into a phoneme sequence composed of a plurality of phonemes;

a phoneme manual modifying section that allows manual modification of a result of the conversion by the phoneme sequence converting section;

an alignment estimating section that estimates a start time and a finish time of each of the phonemes included in the phoneme sequence in the audio signal of input singing voice after estimating an alignment grammar;

an alignment and manual modifying section that allows manual modification of the start time and the finish time of each of the phonemes included in the phoneme sequence estimated by the alignment estimating section;

a phoneme-to-syllable sequence converting section that converts the phoneme sequence into a sequence of syllables;

a voiced segment amending section that amends a deviation of the voiced segment in the syllable sequence output from the phoneme-to-syllable sequence converting section;

a syllable boundary correcting section that allows correction of an error in a syllable boundary in the syllable sequence where the deviation of the voiced segment has been amended, when a user manually points out the syllable boundary error; and a lyric data storing section that stores the syllable sequence as the lyric data having the specified syllable boundaries.

24. The singing synthesis parameter data estimation system according to claim 23, wherein the voiced segment amending section comprises:

a partial syllable sequence generating section that connects a plurality of the syllables included in one of the voiced segments resulting from analysis by the input singing voice audio signal analysis section, thereby generating a partially connected syllable sequence; and an expansion and contraction modifying section that extends or contracts the syllable by changing the start time and the finish time of each of the syllables included in the partially connected syllable sequence so that a voiced segment resulting from analysis of the temporary audio signal of synthesized singing voice obtained by synthesis by the singing synthesis section coincides with the voiced segment resulting from the analysis by the input singing voice audio signal analysis section.

25. The singing synthesis parameter data estimation system according to claim 23, wherein the syllable boundary correcting section comprises:

a calculating section that calculates a temporal variation in a spectrum of the audio signal of input singing voice; and a correction executing section that sets a segment comprising N1 (N1 being a positive integer of one or more) syllables before a point of the syllable boundary error and N1 syllables after the point of the syllable boundary error to a candidate calculation target segment, and sets a segment comprising N2 (N2 being a positive integer of one or more) syllables before the point of the syllable boundary error and N2 syllables after the point of the syllable boundary error to a distance calculation segment, determines N3 (N3 being a positive integer of one or more) points with large temporal variations in the spectrum as boundary candidate points based on a temporal variation in the spectrum in the candidate calculation target segment, obtains distances of hypotheses where the syllable boundary is shifted to the respective boundary candidate points, presents one of the hypotheses having the minimum distance to the user, moves down the boundary candidate point to present another hypothesis until the user determines the presented another hypothesis to be correct, and executes the correction by shifting the syllable boundary to the boundary candidate point for the presented another hypothesis when the user determines the presented another hypothesis to be correct.

26. The singing synthesis parameter data estimation system according to claim 25, wherein the correcting executing section, in order to obtain the distance of hypothesis where the syllable boundary is shifted to the boundary candidate point, estimates the pitch parameter for the distance calculation segment, obtains an audio signal of synthesized singing voice obtained by synthesis of the singing synthesis parameter data estimated based on the estimated pitch parameter, and calculates a spectral distance between the audio signal of input singing voice and the audio signal of synthesized singing voice for the distance calculation segment as the distance of hypothesis.

27. The singing synthesis parameter data estimation system according to claim 15, further comprising:

a pitch transposing section that adds an arbitrary value to the pitch feature data, thereby performing pitch transposition.

28. The singing synthesis parameter data estimation system according to claim 15, wherein the input voice audio signal analysis section further includes a function of monitoring from the pitch feature data a segment where a vibrato is present and then storing the segment with the vibrato in the analyzed data storing section as a vibrato segment; and the singing synthesis parameter data estimation system further comprises:

a vibrato adjusting section that arbitrarily adjusts a vibrato extent in the vibrato segment.

29. The singing synthesis parameter data estimation system according to claim 16, wherein the input voice audio signal analysis section further includes a function of monitoring from the pitch feature data a segment where a vibrato is present and then storing the segment with the vibrato in the analyzed data storing section as a vibrato segment; and the singing synthesis parameter data estimation system further comprises:

a vibrato adjusting section that arbitrarily adjusts a vibrato extent in the vibrato segment.

30. The singing synthesis parameter data estimation system according to claim 15, wherein the input singing voice audio signal analysis section further includes the function of monitoring from the pitch feature data the segment where the vibrato is present and then storing the segment with the vibrato in the analyzed data storing section as the vibrato segment; and the singing synthesis parameter data estimation system further comprises:

a smoothing section that arbitrarily smoothes the pitch feature data and the dynamics feature data in segments other than the vibrato segment.

31. The singing synthesis parameter data estimation system according to claim 16, wherein the input singing voice audio signal analysis section further includes the function of monitoring from the pitch feature data the segment where the vibrato is present and then storing the segment with the vibrato in the analyzed data storing section as the vibrato segment; and the singing synthesis parameter data estimation system further comprises:

a smoothing section that arbitrarily smoothes the pitch feature data and the dynamics feature data in segments other than the vibrato segment.

32. The singing synthesis parameter data estimation system according to claim 17, wherein the input singing voice audio signal analysis section further includes the function of monitoring from the pitch feature data the segment where the vibrato is present and then storing the segment with the vibrato in the analyzed data storing section as the vibrato segment; and the singing synthesis parameter data estimation system further comprises:

a smoothing section that arbitrarily smoothes the pitch feature data and the dynamics feature data in segments other than the vibrato segment.

33. A singing synthesis parameter data estimation method of estimating singing synthesis parameter data used in a singing synthesis system by a computer, the singing synthesis system comprising:

a singing sound source database storing one or more singing sound source data;

a singing synthesis parameter data storing section that stores singing synthesis parameter data which represents an audio signal of singing voice by a plurality of parameters including at least both of a pitch parameter and a dynamics parameter;

a lyric data storing section that stores lyric data having specified syllable boundaries corresponding to an audio signal of input singing voice; and a singing synthesis section that synthesizes and outputs an audio signal of synthesized singing voice suited to the singing sound source data selected from the singing sound source database, based on the singing sound source data, the singing synthesis parameter data, and the lyric data;

the singing synthesis parameter data estimation method implemented by the computer comprising:

analyzing a plurality of features of the audio signal of input singing voice, the features including at least both of a pitch feature and a dynamics feature;

estimating the pitch parameter, by which a pitch feature of the audio signal of synthesized singing voice is got close to the pitch feature of the audio signal of input singing voice, based on at least both of the pitch feature and the lyric data of the audio signal of input singing voice, with the dynamics parameter kept constant;

converting the dynamics feature of the audio signal of input singing voice to a relative value with respect to a dynamics feature of the audio signal of synthesized singing voice after the pitch parameter has been completely estimated;

estimating the dynamics parameter, by which the dynamics feature of the audio signal of synthesized singing voice is get close to the dynamics feature of the audio signal of input singing voice that has been converted to the relative value; and estimating the singing synthesis parameter data, based on the estimated pitch parameter and the estimated dynamics parameter to store the singing synthesis parameter data in the singing synthesis parameter data storing section;

the method further comprising:

repeating estimation of the pitch parameter predetermined times until the pitch feature of a temporary audio signal of synthesized singing voice reaches a pitch feature close to the pitch feature of the audio signal of input singing voice, or repeating estimation of the pitch parameter until the pitch feature of the temporary audio signal of synthesized singing voice converges to the pitch feature of the audio signal of input singing voice, the temporary audio signal of synthesized singing voice being obtained by synthesis of temporary singing synthesis parameter data estimated based on the estimated pitch parameter, by the singing synthesis section; and repeating estimation of the dynamics parameter predetermined times until the dynamics feature of a temporary audio signal of synthesized singing voice reaches a dynamics feature close to the dynamics feature of the audio signal of input singing voice that has been converted to the relative value, or repeating estimation of the dynamics parameter until the dynamics feature of the temporary audio signal of synthesized singing voice converges to the dynamics feature of the audio signal of input singing voice that has been converted to the relative value, the temporary audio signal of synthesized singing voice being obtained by synthesis of temporary singing synthesis parameter data by the singing synthesis section, the temporary singing synthesis parameter data being generated based on the completely estimated pitch parameter and the estimated dynamics parameter.

34. A singing synthesis parameter data estimation program implemented by a computer when the computer estimates singing synthesis parameter data used in a singing synthesis system, the singing synthesis system comprising:

a singing sound source database storing one or more singing sound source data;

a singing synthesis parameter data storing section that stores singing synthesis parameter data which represents an audio signal of singing voice by a plurality of parameters including at least both of a pitch parameter and a dynamics parameter;

a lyric data storing section that stores lyric data having specified syllable boundaries corresponding to an audio signal of input singing voice; and the singing synthesis section that synthesizes and outputs an audio signal of synthesized singing voice suited to the singing sound source data selected from the singing sound source database, based on the singing sound source data, the singing synthesis parameter data, and the lyric data;

the singing synthesis parameter data estimation program configuring in the computer:

an input singing voice audio signal analysis section that analyzes a plurality of features of the audio signal of input singing voice, the features including at least both of a pitch feature and a dynamics feature;

a pitch parameter estimating section that estimates the pitch parameter, by which a pitch feature of the audio signal of synthesized singing voice is got close to the pitch feature of the audio signal of input singing voice, based on at least both of the pitch feature and the lyric data of the audio signal of input singing voice, with the dynamics parameter kept constant;

a dynamics parameter estimating section that, after the pitch parameter estimating section has completed estimation of the pitch parameter, converts the dynamics feature of the audio signal of input singing voice to a relative value with respect to a dynamics feature of the audio signal of synthesized singing voice and estimates the dynamics parameter, by which the dynamics feature of the audio signal of synthesized singing voice is got close to the dynamics feature of the audio signal of input singing voice that has been converted to the relative value; and a singing synthesis parameter data estimating section that estimates the singing synthesis parameter data, based on the pitch parameter estimated by the pitch parameter estimating section and the dynamics parameter estimated by the dynamics parameter estimating section to store the singing synthesis parameter data in the singing synthesis parameter data storing section;

the pitch parameter estimating section repeating estimation of the pitch parameter predetermined times until the pitch feature of a temporary audio signal of synthesized singing voice reaches a pitch feature close to the pitch feature of the audio signal of input singing voice, or repeating estimation of the pitch parameter until the pitch feature of the temporary audio signal of synthesized singing voice converges to the pitch feature of the audio signal of input singing voice, the temporary audio signal of synthesized singing voice being obtained by synthesis of temporary singing synthesis parameter data estimated based on the estimated pitch parameter, by the singing synthesis section;

the dynamics parameter estimating section repeating estimation of the dynamics parameter predetermined times until the dynamics feature of a temporary audio signal of synthesized singing voice reaches a dynamics feature close to the dynamics feature of the audio signal of input singing voice that has been converted to the relative value, or repeating estimation of the pitch parameter until the dynamics feature of the temporary audio signal of synthesized singing voice converges to the dynamics feature of the audio signal of input singing voice that has been converted to the relative value, the temporary audio signal of synthesized singing voice being obtained by synthesis of temporary singing synthesis parameter data by the singing synthesis section, the temporary singing synthesis parameter data being generated based on the pitch parameter estimated by the pitch parameter estimating section and the estimated dynamics parameter.

35. A storage medium with the singing synthesis parameter data estimation program according to claim 34 stored therein to be readable by the computer.

* * * * *